US012691354B2

(12) United States Patent
Almes et al.

(10) Patent No.: US 12,691,354 B2
(45) Date of Patent: Jul. 28, 2026

(54) FLEXIBLE SPORTS BAY

(71) Applicant: Dick's Sporting Goods, Inc., Coraopolis, PA (US)

(72) Inventors: Scott B. Almes, Coraopolis, PA (US); Rob Brown, Coraopolis, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 78 days.

(21) Appl. No.: 18/750,809

(22) Filed: Jun. 21, 2024

(65) Prior Publication Data

US 2024/0424377 A1 Dec. 26, 2024

Related U.S. Application Data

(60) Provisional application No. 63/522,667, filed on Jun. 22, 2023.

(51) Int. Cl.
*A63B 71/06* (2006.01)

(52) U.S. Cl.
CPC .... *A63B 71/0622* (2013.01); *A63B 2220/806* (2013.01); *A63B 2225/50* (2013.01)

(58) Field of Classification Search
CPC ..... A63B 71/0622; A63B 2220/806; A63B 2225/50; G06F 3/0482; G06Q 30/0643; G06V 40/23; G09B 19/0038; G16H 20/30; H04N 23/90
See application file for complete search history.

(56) References Cited

U.S. PATENT DOCUMENTS 6,565,448 B2 * 5/2003 Cameron ..... A63B 53/007 473/409
6,669,571 B1 * 12/2003 Cameron ..... A63B 60/42 473/131
7,311,611 B2 * 12/2007 Cameron ..... A63B 69/3676 473/221
8,744,919 B1 * 6/2014 O'Dea ..... G06Q 20/24 705/26.1
9,227,129 B2 * 1/2016 Ishii ..... A63B 69/3605
9,851,374 B2 12/2017 Clark et al.
(Continued)

OTHER PUBLICATIONS

4D Motion Sports, "4D Motion," retrieved from https://4dmotionsports.com/baseball-pro/ on Aug. 8, 2022, 5 pgs.
Batspeed Recon, "Train with Confidence," retrieved from https://batspeedrecon.com/ on Oct. 7, 2022, 9 pgs.
Better Baseball, "Baseball Bat Fitting," retrieved from https://betterbaseball.com/baseball-bat-fitting, Nov. 7, 2021, 4 pgs.
(Continued)

*Primary Examiner* — Joshua Lee
(74) *Attorney, Agent, or Firm* — Foley & Lardner LLP

(57) ABSTRACT

A terminal for use with a sports bay. The terminal can receive a first indication of a selection of a plurality of pieces of sports equipment, provide a first prompt to initiate execution of a plurality of interactions between a user and an object, determine a plurality of characteristics to indicate a first performance of a user when utilizing at least one piece of sports equipment of a plurality of pieces of sports equipment, receive a characteristic to indicate a second performance of the at least one piece of sports equipment of the plurality of pieces of sports equipment, provide a second prompt to indicate a first selection of the at least one piece of sports equipment, and receive a second indication of a second selection of the at least one piece of sports equipment.

20 Claims, 21 Drawing Sheets

(56) References Cited

U.S. PATENT DOCUMENTS

| | | | | |
|---|---|---|---|---|
| 10,080,941 | B2 * | 9/2018 | Brekke | G01S 19/19 |
| 10,350,455 | B2 | 7/2019 | Bentley et al. | |
| 10,380,409 | B2 | 8/2019 | Thornbrue et al. | |
| 10,478,689 | B2 * | 11/2019 | Brekke | A63B 71/0622 |
| 10,786,728 | B2 | 9/2020 | Haas et al. | |
| 10,888,735 | B2 | 1/2021 | Clark et al. | |
| 10,974,121 | B2 | 4/2021 | Thornbrue et al. | |
| 11,426,629 | B2 * | 8/2022 | Thomas | G16H 20/30 |
| 11,648,443 | B2 * | 5/2023 | Wycoff | A63B 69/36 473/409 |
| 11,935,330 | B2 * | 3/2024 | Lee | A63B 24/0087 |
| 11,941,916 | B2 * | 3/2024 | Lee | A63B 24/0062 |
| 12,008,839 | B2 * | 6/2024 | Menaker | G06V 10/62 |
| 12,450,950 | B2 * | 10/2025 | Lee | A63B 24/0062 |
| 2003/0008731 | A1 * | 1/2003 | Anderson | A63B 60/42 473/407 |
| 2013/0173389 | A1 * | 7/2013 | Page | G06Q 30/02 705/26.5 |
| 2017/0001072 | A1 * | 1/2017 | Brekke | G16H 20/30 |
| 2017/0274256 | A1 * | 9/2017 | Brekke | A63B 60/42 |
| 2019/0114690 | A1 * | 4/2019 | Paquette | G06Q 30/0631 |
| 2020/0298057 | A1 * | 9/2020 | Wycoff | G06V 40/23 |
| 2022/0023730 | A1 | 1/2022 | Howenstein et al. | |
| 2023/0356029 | A1 * | 11/2023 | Larsen | A63B 69/3658 |

OTHER PUBLICATIONS

Blast Motion, "3D Bat Swing Tracer: Blast Baseball and Blast Softball 4.3 Update," retrieved from https://blastmotion.com/blog/3d-bat-swing-tracer-baseball-softball/ on Oct. 29, 2024, 5 pgs.

Blast Motion, "Blast Baseball Swing Analyzer," retrieved from https://blastmotion.com/products/baseball/ on Nov. 26, 2022, 5 pgs.

Blast Motion, "How to Use Swing Data for Bat Fitting," retrieved from https://blastmotion.com/blog/how-to-use-swing-data-for-bat-fitting on Oct. 29, 2024, 3 pgs.

C-Motion, Inc., "Biomechanics Research Tools," retrieved from https://c-motion.com/ on Nov. 21, 2022, 14 pgs.

Driveline Baseball, "Bat Fitting: How to Choose a Bat," Sep. 21, 2021, retrieved from https://www.drivelinebaseball.com/2021/09/how-were-using-science-to-make-sure-the-bat-you-swing-is-helping-your-performance/ on Oct. 29, 2024, 12 pgs.

Driveline Baseball, "Driveline Blog," retrieved from https://www.drivelinebaseball.com/ on Nov. 28, 2022, 7 pgs.

Gears Sports, "Gears Baseball Biomechanics," retrieved from https://www.gearssports.com/baseball-biomechanics/ on Oct. 29, 2024, 5 pgs.

HitTrax, "HitTrax—Redefining," retrieved from https://www.hittrax.com/ on Nov. 2, 2022, 10 pgs.

KinaTrax, "KinaTrax Motion Capture," retrieved from https://www.kinatrax.com/kinatrax-motion-capture/ on Oct. 29, 2024, 7 pgs.

* cited by examiner

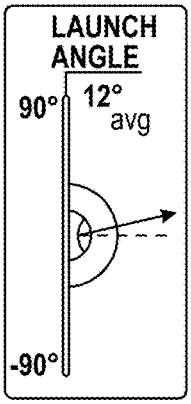

LAUNCH ANGLE

The vertical angle at which the ball leaves your bat after being hit. Angles correlate to different batted ball types (e.g. a line drive is generally between 10-25 degrees), but ultimately depend on your exit velocity.

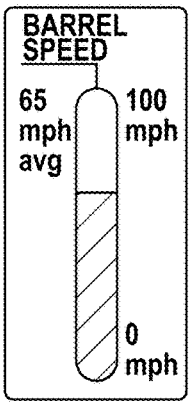

BARREL SPEED

The bat doesn't move at a uniform speed during a swing. The faster the speed of the barrel — not the knob of the bat — as it connects with the ball, the more likely you are to achieve a higher exit velocity.

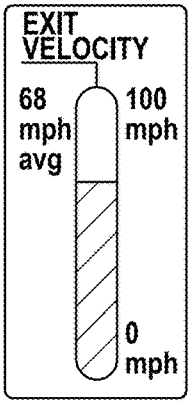

EXIT VELOCITY

The speed of the ball as it comes off of the bat. Exit velocity plays a role in determining the power, and possibly the distance, of your swing; hard hit balls have higher exit velocities.

FIG. 16

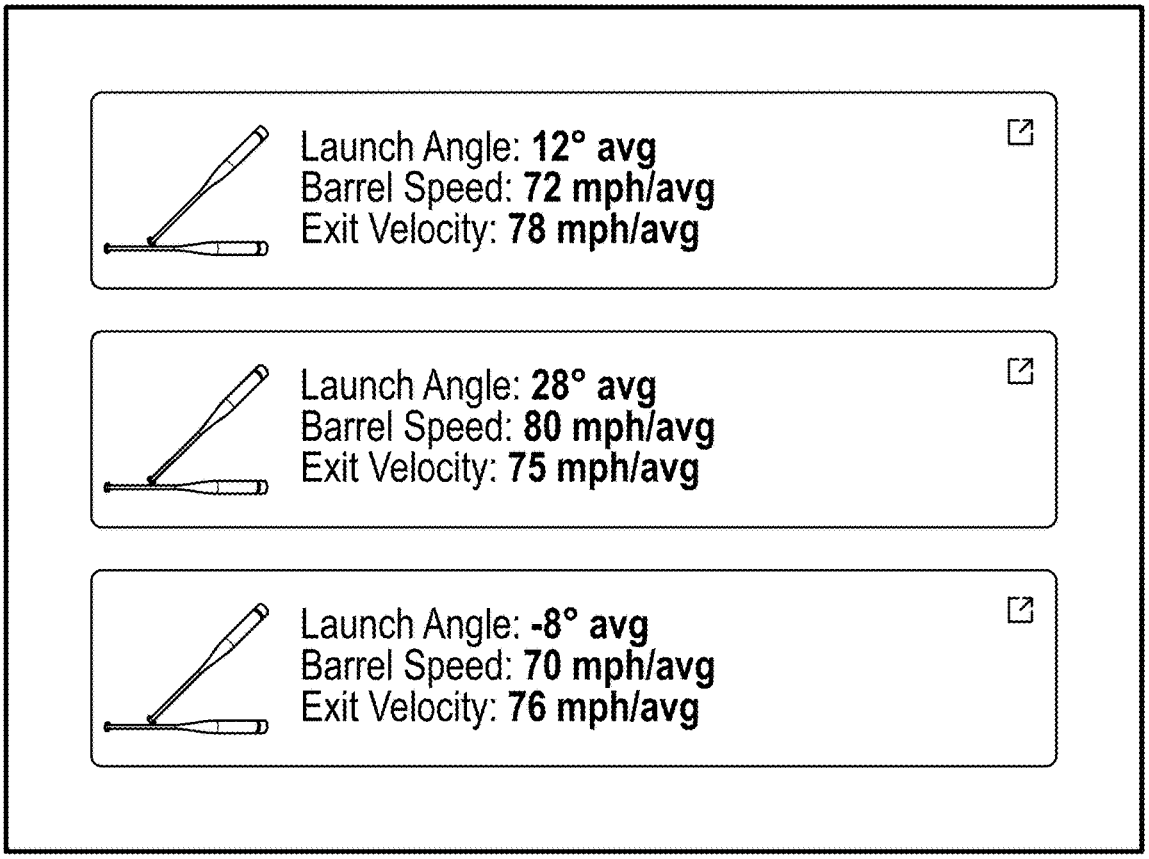

Launch Angle The vertical angle at which the ball leaves your bat after being hit. Angles correlate to different batted ball types (e.g. a line drive is generally between 10-25 degrees), but ultimately depend on your exit velocity Your range: -11 deg to 30 deg

Barrel Speed The bat doesn't move at a uniform speed during a swing. The faster the speed of the barrel — not the knob of the bat — as it connects with the ball, the more likely you are to achieve a higher exit velocity.

Your range: 60 mph to 80 mph

Exit Velocity Exit velocity is the speed of the ball as it comes off of the bat and plays a role in determining the power, and possibly the distance, of your swing; hard hit balls have higher exit velocities.

Your range: 60 mph to 80 mph

The following drills could help you strengthen your swing:

- Offset Open
- Offset Closed
- Step Backs

FIG. 17

FLEXIBLE SPORTS BAY

CROSS-REFERENCE TO RELATED PATENT APPLICATIONS

This application claims the benefit of and priority to U.S. Provisional Patent Application No. 63/522,667, filed on Jun. 22, 2023, the entirety of which is incorporated by reference herein.

BACKGROUND

Sporting equipment can include various equipment types and the various equipment types can include one or more characteristics.

SUMMARY

At least one embodiment relates to a sports bay. The sports bay can include a terminal. The terminal can include one or more memory devices. The one or more memory devices can store instructions thereon. The instructions can, when executed by one or more processors, cause the one or more processors to receive, via a display of the terminal, a first indication of a selection of a plurality of pieces of sports equipment. The first indication can include information to identify the plurality of pieces of sports equipment. The instructions can cause the one or more processors to provide, via the display of the terminal, a first prompt to initiate execution of a plurality of interactions between a user and an object. The user can utilize at least one piece of sports equipment of the plurality of pieces of sports equipment to execute the plurality of interactions. The instructions can cause the one or more processors to determine, responsive to execution of the plurality of interactions, a plurality of characteristics to indicate a first performance of the user when utilizing the at least one piece of sports equipment of the plurality of pieces of sports equipment. The instructions can cause the one or more processors to receive, via the display of the terminal, a characteristic to indicate a second performance of the at least one piece of sports equipment of the plurality of pieces of sports equipment. The instructions can cause the one or more processors to provide, to the display of the terminal, a second prompt to indicate a first selection of the at least one piece of sports equipment of the plurality of pieces of sports equipment. The instructions can cause the one or more processors to receive, via the display of the terminal, a second indication of a second selection of the at least one piece of sports equipment of the plurality of pieces of sports equipment.

In some embodiments, the characteristic can be defined by the user via one or more interactions with the terminal. The instructions can cause the one or more processors to select, responsive to a determination that a difference between the first performance and the second performance is less than a predetermined threshold, the at least one piece of sports equipment of the plurality of pieces of sports equipment. The instructions can cause the one or more processors to provide the second prompt to indicate the first selection of the at least one piece of sports equipment of the plurality of pieces of sports equipment.

In some embodiments, the sports bay can include a camera. The camera can obtain information associated with interactions within the sports bay. The instructions can cause the one or more processors to receive, from the camera responsive to execution of the plurality of interactions, a first set of data corresponding to one or more aspects of the plurality of interactions. The instructions can cause the one or more processors to identify, from the first set of data, information associated with the at least one piece of sports equipment of the plurality of pieces of sports equipment. The instructions can cause the one or more processors to determine the plurality of characteristics using at least a portion of the information associated with the at least one piece of sports equipment.

In some embodiments, the instructions can cause the one or more processors to query, responsive to receipt of the second selection of the at least one piece of sports equipment, a database to identify a plurality of locations where the at least one piece of sports equipment is present. The instructions can cause the one or more processors to determine, responsive to identifying the plurality of locations, that a user identified location is absent from the plurality of location. The instructions can cause the one or more processors to identify, using one or more aspects of the at least one piece of sports equipment, one or more second pieces of sports equipment.

In some embodiments, the instructions can cause the one or more processors to query, responsive to receipt of the second selection of the at least one piece of sports equipment, a database to identify one or more second pieces of sports equipment similar to the at least one piece of sports equipment. The instructions can cause the one or more processors to provide, via the display of the terminal responsive to identification of the one or more second pieces of sports equipment, a visual representation of one or more characteristics of the one or more second pieces of sports equipment. The instructions can cause the one or more processors to receive, from the display of the terminal, a third indication of a selection of the one or more second pieces of sports equipment. The instructions can cause the one or more processors to provide, via the display of the terminal, information associated with one or more sources to obtain the one or more second pieces of sports equipment.

In some embodiments, the instructions can cause the one or more processors to prompt, responsive to receipt of the first indication of the selection of the plurality of pieces of sports equipment, the user for information to identify a plurality of criteria pertaining to usage of the plurality of pieces of sports equipment. The instructions can cause the one or more processors to receive, from the display of the terminal, the information to identify the plurality of criteria. The instructions can cause the one or more processors to determine, using the plurality of criteria and characteristics of the plurality of pieces of sports equipment, that at least one second piece of sports equipment of the plurality of pieces of sports equipment is excluded from consideration. The instructions can cause the one or more processors to provide, via the display of the terminal, a notice to indicate exclusion of the at least one second piece of sports equipment of the plurality of pieces of sports equipment.

In some embodiments, the instructions can cause the one or more processors to receive, via the display of the terminal, a first selection of a mode of the sports bay. The instructions can cause the one or more processors to determine, based on one or more characteristics of the mode, a set of parameters pertaining to a camera proximate to the sports bay. The instructions can cause the one or more processors to control, using the set of parameters, the camera to execute a plurality of operations to obtain information associated with the plurality of interactions.

In some embodiments, the instructions can cause the one or more processors to receive, via the display of the terminal, a second selection of a second mode of the sports bay. The instructions can cause the one or more processors to determine, based on one or more characteristics of the second mode, a second set of parameters pertaining to the camera. The instructions can cause the one or more processors to control, using the second set of parameters, the camera to execute a second plurality of operations to obtain information associated with a second plurality of interactions. The second plurality of operations can be different than the plurality of operations.

In some embodiments, the mode can be an equipment testing mode configured to test equipment for a first sport, and the second mode can be a second equipment testing mode configured to test equipment for a second sport.

In some embodiments, the instructions can cause the one or more processors to control a camera to execute one or more first operations based on the selection of the plurality of pieces of sports equipment corresponding to a first mode of the sports bay. The instructions can cause the one or more processors to control the camera to execute one or more second operations based on the selection of the plurality of pieces of sports equipment corresponding to a second mode of the sports bay.

At least one embodiment relates to a system. The system can include one or more memory devices. The one or more memory devices can store instructions thereon. The instructions can, when executed by one or more processors, cause the one or more processors to receive, from a device, a first indication of a selection of a plurality of pieces of sports equipment. The first indication can include information to identify the plurality of pieces of sports equipment. The instructions can cause the one or more processors to provide, to the device, a first prompt to initiate execution of a plurality of interactions between a user and an object. The user can utilize at least one piece of sports equipment of the plurality of pieces of sports equipment to execute the plurality of interactions. The instructions can cause the one or more processors to determine, responsive to execution of the plurality of interactions, a plurality of characteristics to indicate a first performance of the user when utilizing the at least one piece of sports equipment of the plurality of pieces of sports equipment. The instructions can cause the one or more processors to receive, from the device, a characteristic to indicate a second performance of the at least one piece of sports equipment of the plurality of pieces of sports equipment. The instructions can cause the one or more processors to provide, to the device, a second prompt to indicate a first selection of the at least one piece of sports equipment of the plurality of pieces of sports equipment. The instructions can cause the one or more processors to receive, from the device, a second indication of a second selection of the at least one piece of sports equipment of the plurality of pieces of sports equipment.

In some embodiments, the characteristic can be by the user via one or more interactions with the device. The instructions can cause the one or more processors to select, responsive to a determination that a difference between the first performance and the second performance is less than a predetermined threshold, the at least one piece of sports equipment of the plurality of pieces of sports equipment. The instructions can cause the one or more processors to provide the second prompt to indicate the first selection of the at least one piece of sports equipment of the plurality of pieces of sports equipment.

In some embodiments, the instructions can cause the one or more processors to receive, from a camera responsive to execution of the plurality of interactions, a first set of data corresponding to one or more aspects of the plurality of interactions. The instructions can cause the one or more processors to identify, from the first set of data, information associated with the at least one piece of sports equipment of the plurality of pieces of sports equipment. The instructions can cause the one or more processors to determine the plurality of characteristics using at least a portion of the information associated with the at least one piece of sports equipment.

In some embodiments, the instructions can cause the one or more processors to query, responsive to receipt of the second selection of the at least one piece of sports equipment, a database to identify a plurality of locations where the at least one piece of sports equipment is present. The instructions can cause the one or more processors to determine, responsive to identifying the plurality of locations, that a user identified location is absent from the plurality of location. The instructions can cause the one or more processors to identify, using one or more aspects of the at least one piece of sports equipment, one or more second pieces of sports equipment.

In some embodiments, the instructions can cause the one or more processors to query, responsive to receipt of the second selection of the at least one piece of sports equipment, a database to identify one or more second pieces of sports equipment similar to the at least one piece of sports equipment. The instructions can cause the one or more processors to provide, to the device responsive to identification of the one or more second pieces of sports equipment, a visual representation of one or more characteristics of the one or more second pieces of sports equipment. The instructions can cause the one or more processors to receive, from the device, a third indication of a selection of the one or more second pieces of sports equipment. The instructions can cause the one or more processors to provide, to the device, information associated with one or more sources to obtain the one or more second pieces of sports equipment.

In some embodiments, the instructions can cause the one or more processors to prompt, responsive to receipt of the first indication of the selection of the plurality of pieces of sports equipment, the user for information to identify a plurality of criteria pertaining to usage of the plurality of pieces of sports equipment. The instructions can cause the one or more processors to receive, from the device, the information to identify the plurality of criteria. The instructions can cause the one or more processors to determine, using the plurality of criteria and characteristics of the plurality of pieces of sports equipment, that at least one second piece of sports equipment of the plurality of pieces of sports equipment is excluded from consideration. The instructions can cause the one or more processors to provide, to the device, a notice to indicate exclusion of the at least one second piece of sports equipment of the plurality of pieces of sports equipment.

In some embodiments, the device can include a terminal. The terminal can be associated with a sports bay. The terminal can include one or more second memory devices. The one or more second memory devices can store instructions. The instructions can, when executed by one or more second processors, cause the one or more second processors receive, via a display of the terminal, a first selection of a mode of the sports bay. The instructions can cause the one or more second processors to determine, based on one or more characteristics of the mode, a set of parameters pertaining to a camera proximate to the sports bay. The instructions can cause the one or more second processors to control, using the set of parameters, the camera to execute a plurality of operations to obtain information associated with the plurality of interactions.

At least one embodiment relates to a terminal. The terminal can be for use with a sports bay. The terminal can include one or more memory devices. The one or more memory devices can store instructions thereon. The instructions can, when executed by one or more processors, cause the one or more processors to receive, via a display of the terminal, a first indication of a selection of a plurality of pieces of sports equipment. The first indication can include information to identify the plurality of pieces of sports equipment. The instructions can cause the one or more processors to provide, via the display of the terminal, a first prompt to initiate execution of a plurality of interactions between a user and an object. The user can utilize at least one piece of sports equipment of the plurality of pieces of sports equipment to execute the plurality of interactions. The instructions can cause the one or more processors to determine, responsive to execution of the plurality of interactions, a plurality of characteristics to indicate a first performance of the user when utilizing the at least one piece of sports equipment of the plurality of pieces of sports equipment. The instructions can cause the one or more processors to receive, via the display of the terminal, a characteristic to indicate a second performance of the at least one piece of sports equipment of the plurality of pieces of sports equipment. The instructions can cause the one or more processors to provide, to the display of the terminal, a second prompt to indicate a first selection of the at least one piece of sports equipment of the plurality of pieces of sports equipment. The instructions can cause the one or more processors to receive, via the display of the terminal, a second indication of a second selection of the at least one piece of sports equipment of the plurality of pieces of sports equipment.

In some embodiments, the characteristic can be defined by the user via one or more interactions with the terminal. The instructions can cause the one or more processors to select, responsive to a determination that a difference between the first performance and the second performance is less than a predetermined threshold, the at least one piece of sports equipment of the plurality of pieces of sports equipment. The instructions can cause the one or more processors to provide the second prompt to indicate the first selection of the at least one piece of sports equipment of the plurality of pieces of sports equipment.

In some embodiments, the sports bay can include a camera. The camera can obtain information associated with interactions within the sports bay. The instructions can cause the one or more processors to receive, from the camera responsive to execution of the plurality of interactions, a first set of data corresponding to one or more aspects of the plurality of interactions. The instructions can cause the one or more processors to identify, from the first set of data, information associated with the at least one piece of sports equipment of the plurality of pieces of sports equipment. The instructions can cause the one or more processors to determine the plurality of characteristics using at least a portion of the information associated with the at least one piece of sports equipment.

At least one embodiment relates to a system. The system can include one or more memory devices. The one or more memory devices can store instructions. The instructions can, when executed by one or more processors, cause the one or more processors to receive, from a first device, a first indication of a selection of a plurality of pieces of sports equipment, the first indication including information to identify the plurality of pieces of sports equipment. The instructions can also cause the one or more processors to provide, to the first device, a first prompt to initiate execution of a plurality of interactions between a user and an object, wherein the user utilizes at least one piece of sports equipment of the plurality of pieces of sports equipment to execute the plurality of interactions. The instructions can also cause the one or more processors to receive, from a second device responsive to execution of the plurality of interactions, a first set of data corresponding to one or more aspects of the plurality of interactions. The instructions can also cause the one or more processors to identify, from the first set of data, information associated with the at least one piece of sports equipment of the plurality of pieces of sports equipment. The instructions can also cause the one or more processors to determine, using at least a portion of the information associated with the at least one piece of sports equipment, a plurality of characteristics to indicate a first performance of the user when utilizing the at least one piece of sports equipment of the plurality of pieces of sports equipment. The instructions can also cause the one or more processors to receive, from the first device, a user defined characteristic to indicate a second performance of the at least one piece of sports equipment of the plurality of pieces of sports equipment. The instructions can also cause the one or more processors to provide, to the first device responsive to a determination that a difference between the first performance and the second performance is less than a predetermined threshold, a second prompt to indicate selection of the at least one piece of sports equipment of the plurality of pieces of sports equipment, and receive, from the first device, a second indication of a selection of the at least one piece of sports equipment of the plurality of pieces of sports equipment.

In some embodiments, the instructions can also cause the one or more processors to query, responsive to receipt of the selection of the at least one piece of sports equipment, a database to identify a plurality of locations where the at least one piece of sports equipment is present. The instructions can also cause the one or more processors to determine, responsive to identifying the plurality of locations, that a user identified location is absent from the plurality of location, and identify, using one or more aspects of the at least one piece of sports equipment, one or more second pieces of sports equipment.

In some embodiments, the instructions can also cause the one or more processors to query, responsive to receipt of the selection of the at least one piece of sports equipment, a database to identify one or more second pieces of sports equipment similar to the at least one piece of sports equipment. The instructions can also cause the one or more processors to provide, to the first device responsive to identification of the one or more second pieces of sports equipment, a visual representation of one or more characteristics of the one or more second pieces of sports equipment. The instructions can also cause the one or more processors to receive, from the first device, a third indication of a selection of the one or more second pieces of sports equipment, and provide, to the first device, information associated with one or more sources to obtain the one or more second pieces of sports equipment.

In some embodiments, the instructions can also cause the one or more processors to prompt, responsive to receipt of the first indication of the selection of the plurality of pieces of sports equipment, the user for information to identify a plurality of criteria pertaining to usage of the plurality of pieces of sports equipment. The instructions can also cause the one or more processors to receive, from the first device, the information to identify the plurality of criteria. The instructions can also cause the one or more processors to determine, using the plurality of criteria and characteristics of the plurality of pieces of sports equipment, that at least one second piece of sports equipment of the plurality of pieces of sports equipment is excluded from consideration, and provide, to the first device, a notice to indicate exclusion of the at least one second piece of sports equipment of the plurality of pieces of sports equipment.

At least one embodiment relates to a system. The system can include one or more memory devices. The one or more memory devices can store instructions. The instructions can, when executed by one or more processors, cause the one or more processors to receive, from a first device, a request to initiate a session between a first user and a second user. The instructions can also cause the one or more processors to receive, from a second device associated with the second user responsive to initiation of the session, a request for information associated with the first user. The instructions can also cause the one or more processors to provide, to the first device, a prompt for the information associated with the first user. The instructions can also cause the one or more processors to provide, to the second device, the information associated with the first user responsive to receipt of the information from the first user. The instructions can also cause the one or more processors to receive, from the second device, an indication of a plurality of actions to be executed by the first user. The instructions can also cause the one or more processors to provide, to the first device, a visual representation of the plurality of actions to be executed by the first user. The instructions can also cause the one or more processors to receive, from a third device responsive to execution of the plurality of actions by the first user, a first set of data corresponding to one or more aspects of the plurality of actions, the one or more aspects of the plurality of actions to indicate a performance of the first user. The instructions can also cause the one or more processors to provide, to the second device, the first set of data corresponding to the one or more aspects of the plurality of actions, and receive, from the second device, a second plurality of actions to be executed by the first user to adjust the performance of the first user.

At least one embodiment relates to a sports bay. The sports bay can include a camera and a terminal. The camera can obtain information associated with interactions pertaining to a plurality of modes of the sports bay. The terminal can include one or more processing circuits. The one or more processing circuits can be in communication with the camera. The one or more processing circuits can receive, via a display of the terminal, a first selection of a first mode of the plurality of modes of the sports bay. The one or more processing circuits can also determine, based on one or more characteristics of the first mode, a first set of parameters from a plurality of parameters pertaining to the camera. The one or more processing circuits can also control, using the first set of parameters, the camera to execute a first plurality of operations to obtain information associated with a plurality of interactions pertaining to the first mode. The one or more processing circuits can also receive, via the display of the terminal, a second selection of a second mode of the plurality of modes of the sports bay. The one or more processing circuits can also determine, based on one or more characteristics of the second mode, a second set of parameters from the plurality of parameters pertaining to the camera, and control, using the second set of parameters, the camera to execute a second plurality of operations to obtain information associated with a plurality of interactions pertaining to the second mode. At least one parameter of the first set of parameters can be different from at least one parameter of the second set of parameters and at least one operation of the first plurality of operations can be different from at least one operation of the second plurality of operations.

At least one embodiment relates to a terminal. The terminal can be for use in a sports bay. The terminal can include one or more processing circuits. The one or more processing circuits can receive, via a display, a first selection of a first mode of the plurality of modes of the sports bay. The one or more processing circuits can also determine, based on one or more characteristics of the first mode, a first set of parameters from a plurality of parameters pertaining to a camera located proximate to at least a portion of the sports bay. The one or more processing circuits can also control, using the first set of parameters, the camera to execute a first plurality of operations to obtain information associated with a plurality of interactions pertaining to the first mode. The one or more processing circuits can also receive, via the display, a second selection of a second mode of the plurality of modes of the sports bay. The one or more processing circuits can also determine, based on one or more characteristics of the second mode, a second set of parameters from the plurality of parameters pertaining to the camera, and control, using the second set of parameters, the camera to execute a second plurality of operations to obtain information associated with a plurality of interactions pertaining to the second mode. At least one parameter of the first set of parameters can be different from at least one parameter of the second set of parameters, and at least one operation of the first plurality of operations can be different from at least one operation of the second plurality of operations.

In some embodiments, the first mode can be an equipment testing mode that can be configured to test equipment for a first sport, and the second mode can be a remote lesson mode that can be configured to conduct a remote lesson session with an offsite instructor.

In some embodiments, the first mode can be a first equipment testing mode or a first remote lesson mode for a first sport, and the second mode can be a second equipment testing mode or a second remote lesson mode for a second sport.

BRIEF DESCRIPTION OF THE DRAWINGS

FIG. 16 is a user interface for use in providing information obtained pertaining to user interactions with the flexible sports bay illustrated in FIG. 3, according to some embodiments.

FIG. 17 is a user interface for use in providing information obtained pertaining to user interactions with the flexible sports bay illustrated in FIG. 3, according to some embodiments.

DETAILED DESCRIPTION

Figure 1:
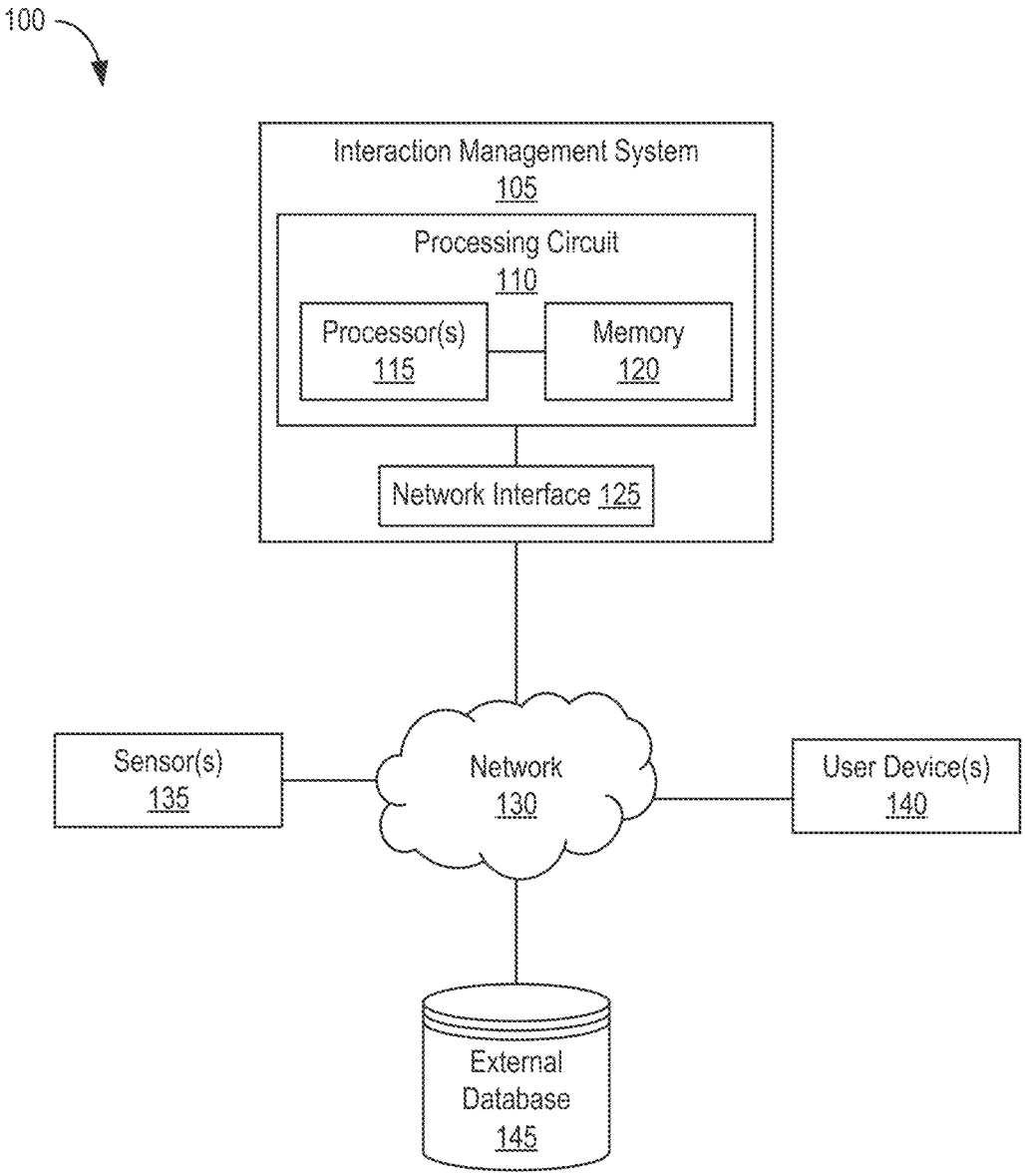
FIG. 1 is a block diagram of a system for managing interactions within a flexible sports bay, according to some embodiments.

The systems and methods described herein relate to flexible sports bays that may assist users in selecting pieces of sporting equipment and/or providing virtual and/or remote training services for one or more sports. For example, a flexible sports bay may include a batting cage or other enclosures, and electrical devices (e.g., sensors, cameras, monitors, kiosk, laptops, etc.) may be disposed within and/or proximate to the batting cage. The electrical devices may capture user interactions within the batting cage. For example, a camera can capture and/or record a user swinging a baseball bat. The information captured by the camera (e.g., information about the user's swing) may be provided to a computer system for processing. The computer system can identify one or more aspects of the user interactions. For example, the computer system can identify various pieces of sporting equipment that were used during the interactions. The computer system can identify at least one of a baseball bat, a softball bat, sports cleats, and/or other types of equipment. For example, the computer system can identify a given model number or a given model type for a baseball bat that was used during the interactions.

The computer system can also group, organize, and/or otherwise track user interactions based on a type and/or piece of sporting equipment. For example, a user may perform a given number of user interactions (e.g., a number of baseball swings) and the computer system can associate the user interactions with baseball bats (e.g., swings 1, 2, and 3 were performed with bat 1 and swings 4, 5, and 6 were performed with bat 2). The computer system can generate performance metrics for each grouping of user interactions (e.g., a first grouping including the swings performed using bat 1 and a second grouping including the swings performed using bat 2).

As another example, a user may perform one or more soccer drills (e.g., user interactions) and the computer system can associate the soccer drills with given soccer cleats (e.g., drill 1 was performed wearing soccer cleats 1 and drill 2 was performed wearing soccer cleats 2). The computer system can generate performance metrics for each grouping of drills (e.g., a first grouping including metrics associated with the user wearing the soccer cleats 1 and a second grouping including metrics associated with the user wearing the soccer cleats 2).

FIG. 1 is a block diagram of a system 100 for managing interactions within a flexible sports bay, according to some embodiments. The system 100 and/or a component thereof may be implemented by the computer system described herein to provide some of the technical solutions described herein. Each system and/or component of the system 100 can include one or more processors, memory, network interfaces, communication interfaces, and/or user interfaces. Memory can store programming logic that, when executed by the processor, implements, controls or otherwise directs the operation of the corresponding computing system or device. Memory can also store data in databases. The network interfaces can allow the systems and/or components of the system 100 to communicate wirelessly. The communication interfaces can include wired and/or wireless communication interfaces and the systems and/or components of the system 100 can be connected via the communication interfaces. The various components in the system 100 can be implemented via hardware (e.g., circuitry), software (e.g., executable code), or any combination thereof. Systems, devices, and components in FIG. 1 can be added, deleted, integrated, separated, and/or rearranged.

The system 100 can include at least one interaction management system 105, at least one network 130, at least one sensor 135, at least one user device 140, and at least one external database 145. The network 130 can be and/or include a local area network (LAN), wide area network (WAN), telephone network (such as the Public Switched Telephone Network (PSTN)), Controller Area Network (CAN), wireless link, intranet, the Internet, a cellular network and/or combinations thereof. The network 130 may allow for the interaction management system 105, the sensors 135, the user devices 140, and/or the external database 145 to interact with and/or otherwise interface with one another. The user devices 140 can be and/or include at least one of a kiosk, a mobile computing device, a desktop computer, a smartphone, a tablet, a smart watch, and/or any other device that can facilitate providing, receiving, displaying and/or otherwise interacting with content (e.g., images, video, audio, text, etc.). In some embodiments, the user device 140 is a kiosk and an operator and/or user can interact with the kiosk to provide and receive information from the interaction management system 105. In some embodiments, the user device 140 may store or maintain an application that includes instructions that, when executed by the user device 140, cause the user device 140 to perform one or more operations similar to that of the interaction management system 105. For example, the user device 140 may store instructions that cause the user device 140 to control the sensors 135. As another example, the user device 140 may store instructions that cause the user device 140 to display a prompt for the user to perform one or more interactions.

In some embodiments, the interaction management system 105, the sensors 135, and the user devices 140 can interface with, interact with, and/or otherwise communicate with another via one or more additional and/or separate networks to that of the network 130. For example, the sensors 135 and the interaction management system 105 can be directly coupled and/or connected to another and the sensors 135 can communicate, via wired communication, with the interaction management system 105. As another example, the sensors 135 can communicate with the user devices 140 via one or more wireless communications (e.g., Bluetooth, CAN, wi-fi, etc.).

The interaction management system 105 can include at least one processing circuit 110 and at least one network interface 125. In some embodiments, the interaction management system 105 can be housed and/or located within a terminal and/or a kiosk of the flexible sports bay. In some embodiments, the terminal housing the interaction management system 105 can be directly coupled and/or directly connected to the sensors 135 and/or the user devices 140 and the terminal can communicate, via wired communication, with at least one of the sensors 135 and/or the user devices 140. The interaction management system 105 can be distributed across one or more servers, one or more cloud computing devices, and/or among other possible remote devices and/or data centers.

The processing circuit 110 can include at least one processor 115 and memory 120. Memory 120 can be one or more devices (e.g., RAM, ROM, Flash memory, hard disk storage) for storing data. Memory 120 can also store computer code and/or instructions for executing, completing and/or facilitating the various processes described herein. For example, memory 120 may store instructions and the instructions may cause the processors 115 to perform functionality similar to that of the interaction management system 105 and/or a component thereof. Memory 120 can be or include non-transient volatile memory, non-volatile memory, and non-transitory computer storage media. Memory 120 can include database components, object code components, script components, or any other type of information structure for supporting the various activities and information structures described herein. Memory 120 can be communicably coupled with the processors 115. Memory 120 can also be electrically coupled with the processors 115. The processors 115 can be implemented as one or more application specific integrated circuits (ASICs), one or more field programmable gate arrays (FPGAs), a group of processing components, and/or other suitable electronic processing components.

The network interface 125 can be and/or include network communication devices, network interfaces, and/or other possible communication interfaces. The network interface 125 can be and/or include wired or wireless communications interfaces (e.g., jacks, antennas, transmitters, receivers, transceivers, wire terminals, etc.) for conducting data communications between the interaction management system 105, the sensors 135, the user devices 140, and/or the external database 145. The network interface 125 can be direct (e.g., local wired or wireless communications) and/or via a communications network (e.g., the network 130). For example, the network interface 125 can include an Ethernet card and port for sending and receiving data via an Ethernet-based communications link or network. The network interface 125 can also include a Wi-Fi transceiver for communicating via a wireless communications network (e.g., the network 130). The network interface 125 can include a power line communications interface. The network interface 125 can include an Ethernet interface, a USB interface, a serial communications interface, and/or a parallel communications interface. The network interface 125 can interface with, interact with and/or otherwise communicate with at least one of various systems and/or components described herein.

The sensors 135 can be housed, positioned, located, and/or other placed within the flexible sports bay. The sensors 135 can be and/or include at least one of cameras, motion detectors, radar sensors, video devices, object tracking equipment, position sensors, computer vision equipment, objection detection devices, and/or various combinations thereof. The sensors 135 can collect, record, obtain, and/or otherwise capture user interactions within the sports bay. For example, the sensors 135 can capture images, video, and/or data associated with a user swinging a baseball bat within the flexible sports bay. The sensors 135 can include at least one of various modes, various configurations, various functionality, various setups, and/or among possible combination. The various modes of the sensors 135 may enable the sensors 135 to perform various services and/or capture various types of user interactions. For example, the flexible sports bay can include the sensors 135 and the sensors 135 can be controlled, by the interaction management system 105, to switch from a first mode (e.g., baseball bat selection and/or bat fitting mode) to a second mode (e.g., soccer cleat selection mode). As another example, the flexible sports bay may include a hockey stick fitting mode (e.g., a first mode) and a lacrosse stick fitting mode (e.g., a second mode). In some embodiments, the flexible sports bay may include various modes associated with one or more sports. For example, the flexible sports bay may include a field hockey mode. As another example, the flexible sports bay may include a golf mode.

In some embodiments, the modularity and/or configuration of the components of the flexible sports bay (e.g., the sensors 135 and the interaction management system 105) can result in the flexible sports bay providing a multiple use area with minimal downtime between various services. In some implementations, the mode may be switched automatically responsive to detecting characteristics of the type of sport or the activity being performed (e.g., switched between a baseball mode and a soccer mode responsive to the cameras identifying a baseball bat or a second ball in the bay, within the hands or proximate to a foot of a user, etc.)

The external database 145 can be distributed across one or more servers, one or more cloud computing devices, and/or among other possible remote devices and/or data centers. The external database 145 can house, store, keep, maintain, and/or otherwise hold at least one of equipment inventory, equipment specification sheets, equipment types, sporting requirements, purchase records, online registers, and/or among various combinations. The external database 145 can communicate with at least one of the interaction management system 105, the sensors 135, and/or the user devices 140. The external database 145 can store, keep, maintain, and/or otherwise hold information that is received from components of the system 100. For example, the external database 145 can store information associated with a user interaction with the flexible sports bay.

The interaction management system 105 can receive an indication of a selection of a plurality of pieces of sports equipment. For example, the interaction management system 105 can be housed within a terminal and the interaction management system 105 can receive the indication responsive to an operator and a user of the terminal interacting with a display of the terminal (e.g., selecting icons on a user interface presented via the display). The indication can include information to identify the plurality of pieces of equipment. For example, the pieces of sports equipment can be baseball bats and the indication may include model numbers for the baseball bats.

The interaction management system 105 can provide a prompt to initiate execution of a plurality of interactions between a user and an object. For example, the interaction management system 105 can generate, create, and/or otherwise provide a user interface including a prompt and the prompt can be provide via the display of the terminal. The plurality of interactions between the user and the object can be or include at least one of a user hitting a baseball (e.g., the object), the user performing drills with a soccer ball (e.g., the object), the user partaking in a lesson (e.g., a hitting lesson), and/or among various other possible interactions.

The interaction management system 105 can receive data corresponding to one or more aspects of the plurality of interactions. For example, the interaction management system 105 can receive data collected, generated, and/or otherwise obtained by the sensors 135. The data obtained by the sensors 135 can include performance metrics associated with the user interactions. For example, if the user interactions were the user hitting a baseball, the performance metrics may include exit velocity, swing angle, bat speed, launch angle, and/or among various other possible performance metrics. As another example, if the user interactions were the user performing one or more soccer drills, the performance metrics may include a number of touches and/or contacts with the soccer ball, a time to completion of the drills, and/or among various other possible performance metrics.

The interaction management system 105 can identify information associated with at least one piece of sports equipment. For example, the interaction management system 105 can parse the information associated with the user interactions to determine which aspects pertain to given pieces of sports equipment. To continue this example, the user may have performed a given number of user interactions and each user interaction may have been performed using at least one piece of sports equipment. The interaction management system 105 can identify information that is associated with the pieces of sports equipment by grouping user interactions with given pieces of sports equipment.

The interaction management system 105 can determine a plurality of characteristics that indicate a performance of the user when utilizing the pieces of sports equipment. For example, the user interactions may have included the user performing 7 baseball swings (e.g., the user interacted with the baseball 7 times) and the baseball swings may have been performed with different baseball bats. To continue this example, the interaction management system 105 can use the groupings (e.g., which swings were performed with which baseball bat) to provide characteristics of the performance with the sports equipment (e.g., how did the user perform with the various baseball bats).

The interaction management system 105 can receive a user defined characteristic to indicate a performance of the pieces of sports equipment. For example, the user may input, via the terminal, an indication of the user's experience with each baseball bat (e.g., I enjoyed bat 1 and disliked bat 2). The user may also indicate that they did not experience any significant differences between the experiences. In some embodiments, the interaction management system 105 may select one or more pieces of sports equipment based on user defined characteristics and measures and/or observed characteristics. For example, a user may provide an indication of a baseball bat that enjoyed using while performing one or more interactions. As another example, the interaction management system 105 may determine given performances of the user while using given pieces of sports equipment. The interaction management system 105 may select a given piece of sports equipment based on the user defined characteristic associated with a piece of sports equipment and a performance of the user while using the piece of sports equipment. Stated otherwise, the interaction management system 105 may select the piece of sports equipment based on a difference between user defined characteristic and the performance being less than a predetermined threshold (e.g., the user enjoyed the piece of sports equipment and performed well while using the piece of sports equipment).

The interaction management system 105 can provide a prompt to indicate selection of at least one piece of sports equipment. For example, the interaction management system 105 may provide, via the terminal, a user interface that includes the performance metrics with the pieces of sports equipment and the user interface may also identify which piece(s) of sports equipment that the user excelled with. The interaction management system 105 can receive, via the terminal, an indication of a selection of the pieces of sports equipment. For example, the indication can be that the user selected a given piece of sports equipment that was used by the user during the user interactions.

The interaction management system 105 can receive a request to initiate a session between one or more users. For example, the interaction management system 105 can receive, via a display on the terminal, a selection from a user to initiate a baseball lesson. The interaction management system 105 can receive a request for information associated with one of the users. For example, the interaction management system 105 can receive a request from a baseball coach for information from the user that provided the request to initiate the session.

The interaction management system 105 can provide a prompt for the information associated with the user. For example, the interaction management system 105 can provide, via a display of the terminal, a user interface that includes a prompt for the user to enter the information. The user can provide, enter, and/or otherwise indicate the information to the interaction management system 105. For example, the display may include a text box and the user can enter the information into the text box. As another example, the terminal may include a Quick Response (QR) code reader and/or scanner and the user can provide information via the QR code reader. The interaction management system 105 can provide the information provided by the user to a second user (e.g., the user that requested the information associated with the user).

The interaction management system 105 can receive an indication of a plurality of actions to be executed by the user. For example, the interaction management system 105 can receive one or more hitting drills and/or hitting exercises that the baseball coach would like for the user to complete. The interaction management system 105 can provide a visual representation of the plurality of actions. For example, the interaction management system 105 can provide, via the terminal, a user interface including at least one of images, videos, and/or illustrations of the plurality of actions.

In some embodiments, one or more of the devices described herein may display or otherwise provide the visual representations. For example, the terminal may display the visual representations. As another example, a monitor located proximate to the sports bay may display the visual representations. In some embodiments, a first device may receive one or more inputs or interactions via a display of the first device. For example, the terminal may receive one or more inputs via a display. In some embodiments, a second device may present information based on the inputs received by the first device. For example, a monitor located proximate to the sports bay may present graphical representations of one or more interactions with sports equipment.

The interaction management system 105 can receive data corresponding to one or more aspects of the plurality of actions. The interaction management system 105 can receive the data responsive to execution of the plurality of actions by the user. The interaction management system 105 can receive the data from the sensors 135. For example, the data may include images captures by the cameras showing the user executing the plurality of actions. The one or more aspects of the plurality of actions can indicate a performance of the first user. For example, the data may include the performance metrics described herein.

The interaction management system 105 can provide the data corresponding to the one or more aspects of the plurality of actions to a device. For example, the interaction management system 105 can provide the data to a user device 140 associated with the baseball coach. The data can be provided via a user interface displayed on the user device 140. The interaction management system 105 can receive a plurality of actions to be executed by the user to adjust a performance of the user. For example, the interaction management system 105 can receive the actions from the user device 140. The plurality of actions can be or include one or more follow up drills, one or more modifications to the previous executed actions, and/or one or more cues and/or further instructions for the user to perform.

Figure 2:
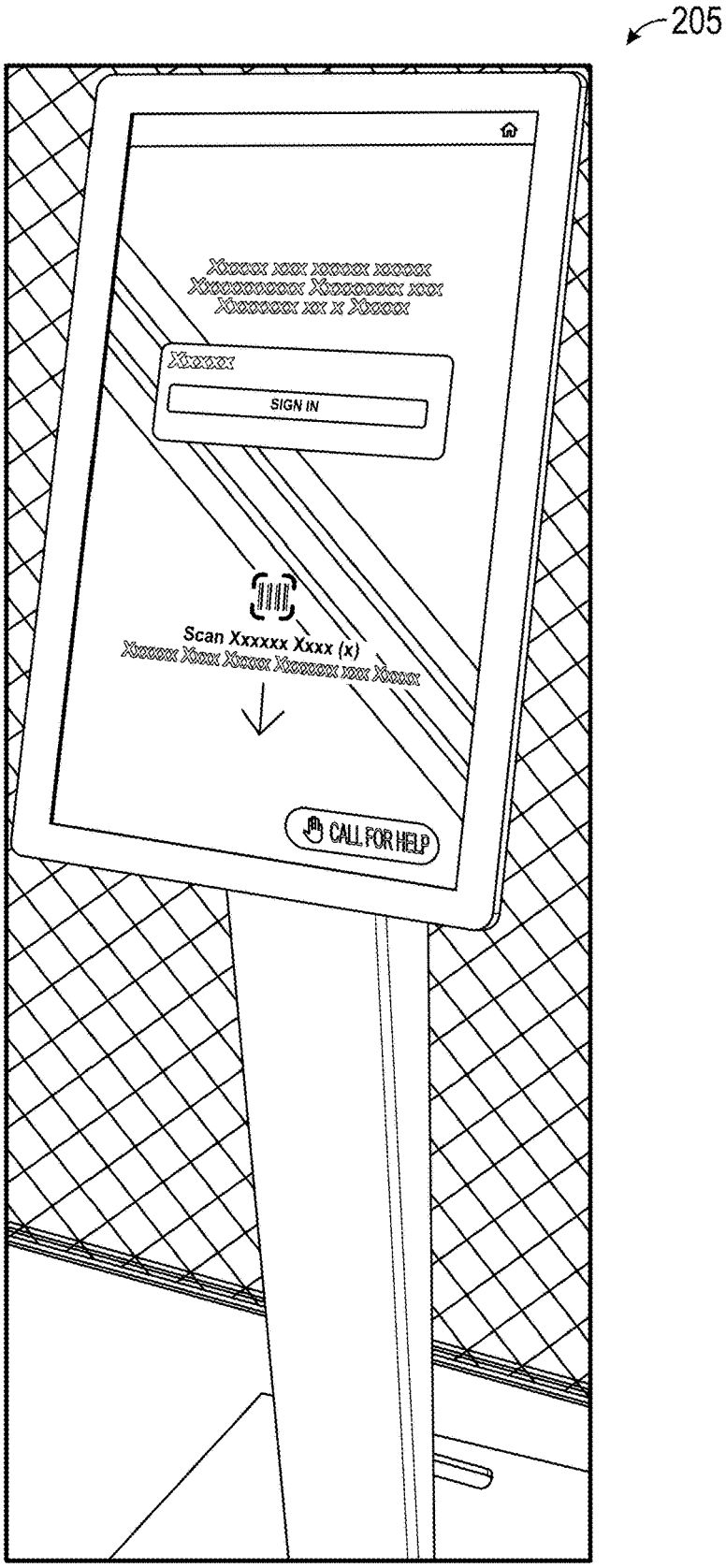
FIG. 2 is a perspective view of a terminal for use in a flexible sports bay, according to some embodiments.

FIG. 2 is a perspective view of a terminal 205, according to some embodiments. The terminal 205 can be included with and/or used in conjunction with the flexible sports bay described herein. The terminal 205 can be and/or include the terminal described herein. The terminal 205 can house, incorporate, and/or otherwise include the interaction management system 105. The terminal 205 can include a display and the display can generate, present, display, and/or otherwise provide at least one of the user interfaces described herein. The terminal 205 can interact with, interface with, and/or otherwise communicate with the sensors 135 and/or the user devices 140. For example, the terminal 205 can be directly coupled with the sensors 135 and the terminal 205 can communicate, via wired communication, with the sensors 135. The terminal 205 can also communicate with at least one of the sensors 135 and/or the user devices 140 via wireless communication (e.g., Bluetooth, CAN, wi-fi, etc.). In some embodiments, the terminal 205 can provide control signals to modify, change, adjust, and/or otherwise alter operations of the sensors 135 to obtain information associated with user interactions with the sports bay. To continue this example, the sports bay can include a plurality of modes (e.g., bat selection mode, baseball coaching mode, remote lesson mode, soccer cleat selection mode, and/or among various possible modes) and the terminal 205 can provide signals to the sensors 135 to configure the sensors 135 with respect to the modes.

Figure 3:
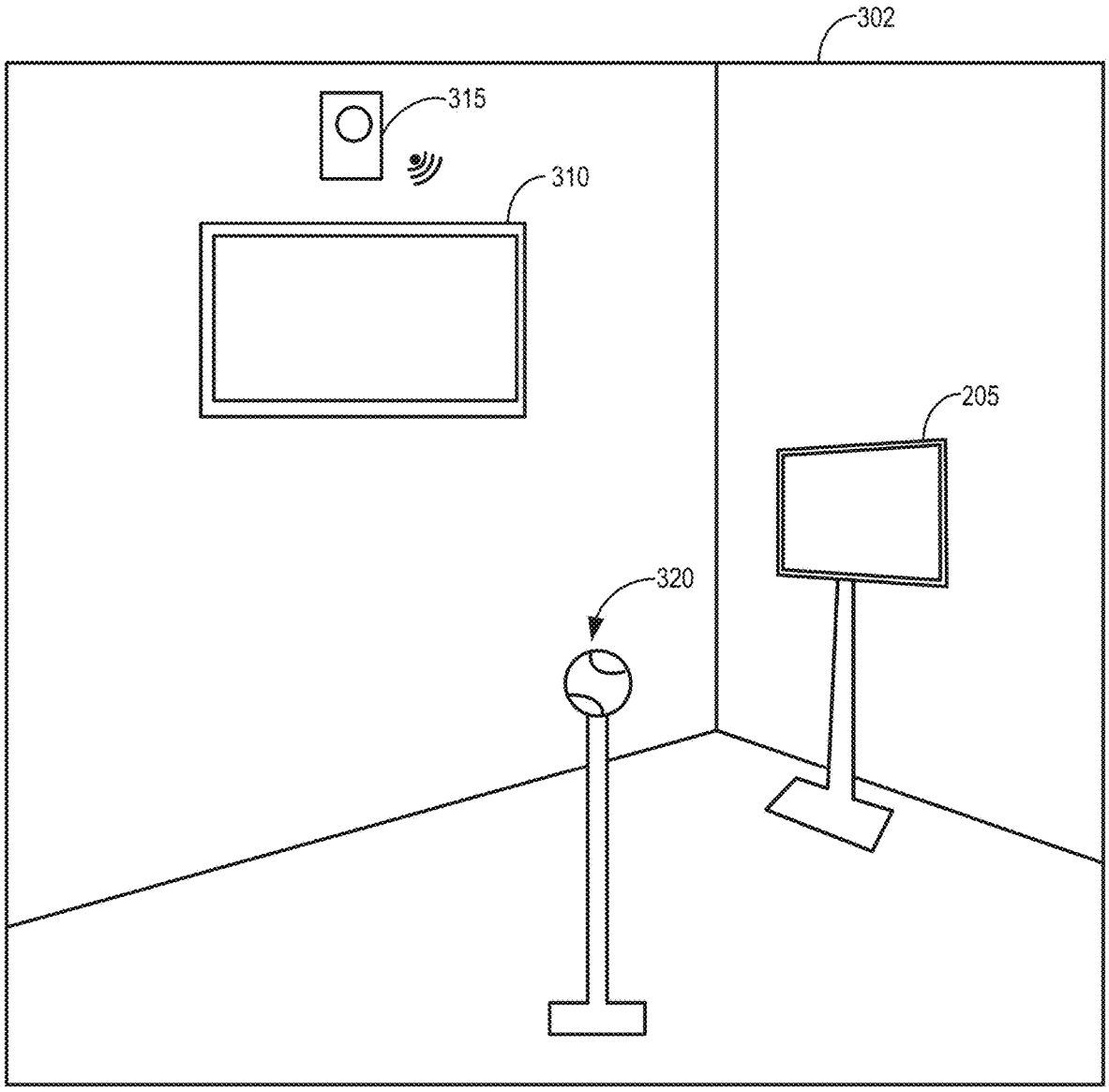
FIG. 3 is a perspective view of a flexible sports bay including the terminal illustrated in FIG. 2, according to some embodiments.

FIG. 3 is a perspective view of a flexible sports bay 302, according to some embodiments. The flexible sports bay 302 can be and/or include the sports bay and/or the flexible sports bay described herein. The flexible sports bay 302 can be and/or include at least one of a barrier, an enclosure, a barricade, fencing, and/or other possible structures. For example, the flexible sports bay 302 can include a batting cage. In some embodiments, the flexible sports bay 302 can be included in, located in, and/or otherwise placed in a store. For example, the flexible sports bay 302 can be located in a sporting goods store. The flexible sports bay 302 can include the terminal 205. For example, the terminal 205 can be housed within, located proximate to, and/or otherwise positioned within the flexible sports bay 302. The flexible sports bay 302 can include at least one device 310, at least one camera 315, and at least one object 320. The device 310 can be and/or include at least one of device described herein. For example, the device 310 can and/or include the user devices 140. The cameras 315 can be and/or include the sensors 135. The objects 320 can be and/or include the various objects described herein. For example, the objects 320 can be a baseball, a baseball bat, a softball, a softball bat, a hitting tee, a soccer ball, a soccer net, a target, and/or among various possible combinations. FIG. 3 depicts an example of the objects 320 including a baseball positioned on a hitting tec.

The cameras 315 can obtain information associated with interaction corresponding to, pertaining to, and/or otherwise associated with a plurality of modes of the flexible sports bay 302. For example, the cameras 315 can generate, capture, and/or otherwise obtain images, videos, performance metrics, and/or among other possible information described herein. The cameras 315 can be designed, configured, and/or otherwise modified to adjust the operations that are performed by the cameras 315. For example, the cameras 315 may perform a first set of operations when the user interactions pertain to bat selection and the cameras 315 may perform a second set of operations when the user interactions pertain to soccer cleat selection. The terminal 205 and/or the interaction management system 105 can communicate with the cameras 315 to adjust the operations of the cameras.

The terminal 205 can receive a selection of at least one mode of the flexible sports bay 302. For example, the terminal 205 can receive, via the display of the terminal 205, a selection of a bat selection mode (e.g., a mode of the flexible sports bay 302). The terminal 205 can receive the selection responsive to an operator and/or user of the terminal 205 interacting with, interfacing with, and/or otherwise engaging with the terminal 205. For example, the user of the terminal 205 can select an icon display on a user interface and the terminal 205 can detect the interaction (e.g., detect the selection of the icon).

The terminal 205 can determine parameters pertaining to the cameras 315. The parameters can pertain to the mode that was selected by the user. For example, the parameters can pertain to a soccer cleat selection mode (e.g., a mode of the flexible sports bay 302). The cameras 315 can include a plurality of parameters and the parameters can be associated with one or more modes. For example, the cameras 315 can include at least one of configuration settings, operating setpoints, operating criteria, operating specifications, and/or among other possible arrangements that correspond to at least one mode of the various modes of the flexible sports bay 302.

The various modes of the flexible sports bay 312 may include and/or implement given interactions and the cameras 315 can perform and/or implement given actions to capture the interactions pertaining to the various modes. For example, during the bat selection mode (e.g., a mode), the cameras 315 may capture information pertaining to the baseball (e.g., the object 320) as well as images of the user hitting the baseball. As another example, during soccer cleat selection (e.g., a mode) the cameras 315 may capture images of the user interacting with the soccer ball. The operations performed by the cameras 315 may vary and/or differ amongst various modes and the terminal 205 can control and/or configure the cameras 315 to perform the operations pertaining to the modes.

The terminal 205 can determine the parameters pertaining to the camera responsive to receiving the selection of the mode of the flexible sports bay 302. For example, the terminal 205 can determine the parameters of the cameras 315 that are associated with bat selection (e.g., a mode of the flexible sports bay 302) based on the one or more aspects included in the user interactions (e.g., the user hitting and/or interacting with the baseball). The terminal 205 can determine the parameters of the cameras 315 based on information that may be used to analyze, evaluate, and/or otherwise grade the user interactions. For example, the terminal 205 can determine that the bat selection mode includes collecting information pertaining to the launch angle of the baseball and the terminal 205 can determine the parameters of the cameras 315 to have the cameras 315 collect information pertaining to the launch angle of the baseball.

The terminal 205 can control the cameras 315 to execute operations to obtain information associated with interactions pertaining to the mode of the flexible sports bay 302. For example, the terminal 205 can provide, to the cameras 315, control signals and/or operating settings that result in the cameras 315 performing given operations to obtain information associated with bat selection. To continue this example, the cameras 315 may perform a given number of steps and/or a given order of steps based on the parameters determined by the terminal 205.

The terminal 205 can receive one or more selections. For example, the terminal 205 can receive a first selection, from a first user, pertaining to baseball instructions and the terminal 205 can receive, a second selection, from a second user, pertaining to soccer cleat selection. The terminal 205 can determine the parameters for the various selected modes and the terminal 205 can control the cameras 315 using the parameters. The parameters for the various selected modes can be different. For example, a first mode can include a first set of parameters and a second mode can include a second set of parameters. To continue this example, at least one parameter in the first set of parameters can be different from at least one parameter in the second set of parameters.

While some examples pertaining to given sports or sports activities have been described herein, the disclosure is not limited to these examples. For example, the interactions may include a user performing one or more drills or actions pertaining to hockey. As another example, the interactions may include a user performing one or more drills or actions pertaining to lacrosse.

User Interfaces

The various systems, devices, and/or components described herein can generate, create, provide, display, exhibit, and/or otherwise present at least one user interface. For example, the terminal 205 can generate a user interface and the user interface can be presented via a display device (e.g., a screen, monitor, and/or otherwise possible display devices) of the terminal 205. An operator and/or user of the terminal 205 can interface with, interact with, and/or otherwise engage with various portions of the user interfaces to provide information to and/or receive information from the terminal 205 and/or the interaction management system 105. For example, the user can select a mode of the flexible sports bay 302 by engaging (e.g., touching and/or selecting) an icon displayed and/or included in a user interface.

The various user interfaces described herein can be generated and display by the various systems, devices, and/or components described herein. The various user interfaces can be provided to the user devices 140 and the user devices 104 can display, responsive to receiving the user interfaces, the user interfaces. The various user interfaces can be presented as at least one of pop-up windows, image overlays, scrolling pages and/or scrolling windows, and/or among various possible alternatives and/or combinations. For example, the terminal 205 may display a first user interface including a plurality of icons and a selection of a first icon may cause a pop-up window to be display on top of and/or in conjunction with the first user interface.

Figure 4:
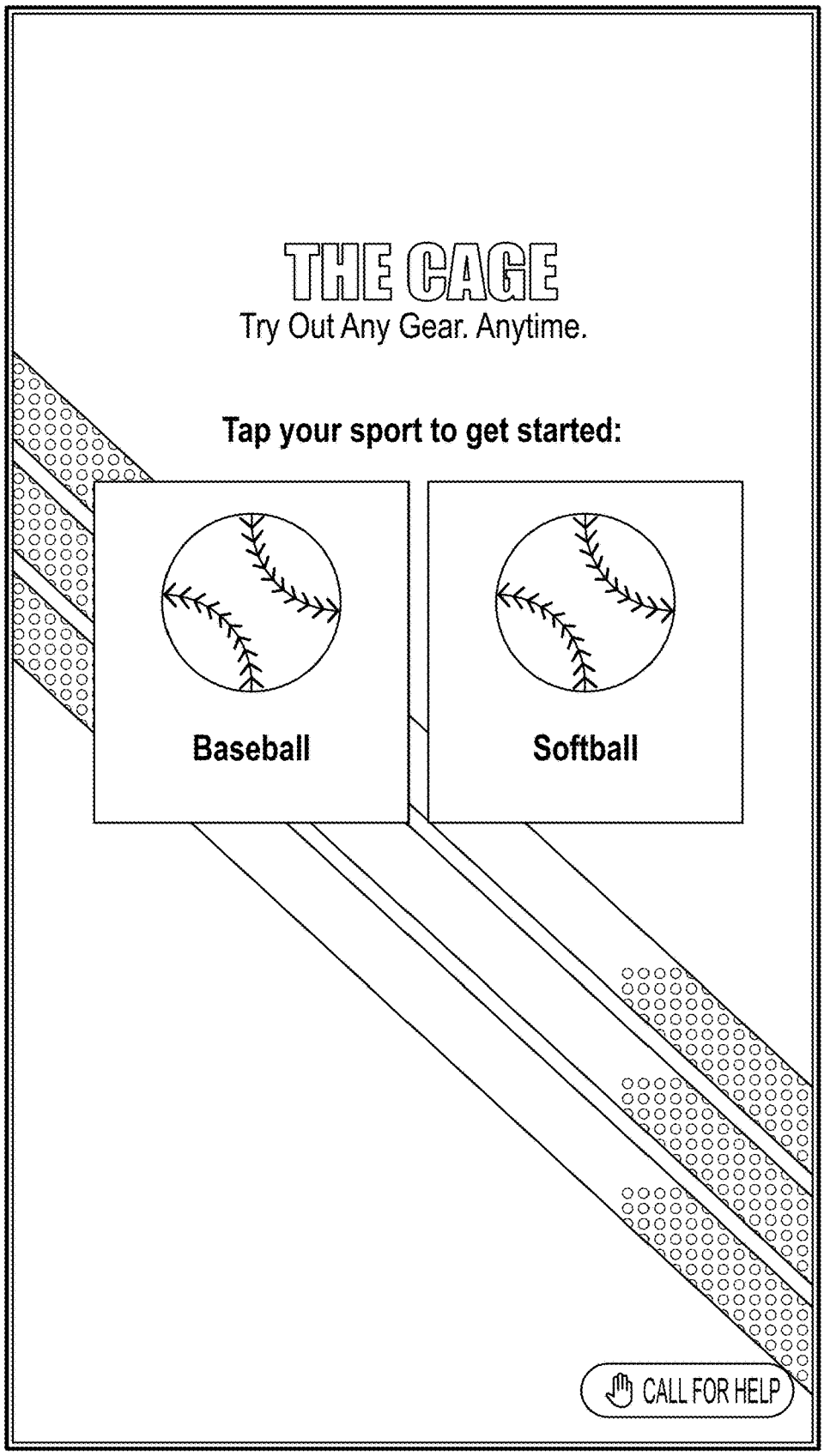
FIG. 4 is a user interface for use in providing user selections pertaining to one or more interactions within the flexible sports bay illustrated in FIG. 3, according to some embodiments.

FIG. 4 depicts an example user interface, according to some embodiments. The user interface can include at least one icon and/or visual display. FIG. 4 shows an example of the user interface including an icon associated with baseball and an icon associated with softball. The user interface can be displayed by the terminal 205. An operator and/or a user of the terminal 205 can interface with, interact with, and/or otherwise engage with one of the icons to provide an indication to the terminal 205. For example, the user can select the baseball icon to provide an indication to the terminal 205 that the user is interested with seeing information pertaining to baseball.

Figure 5:
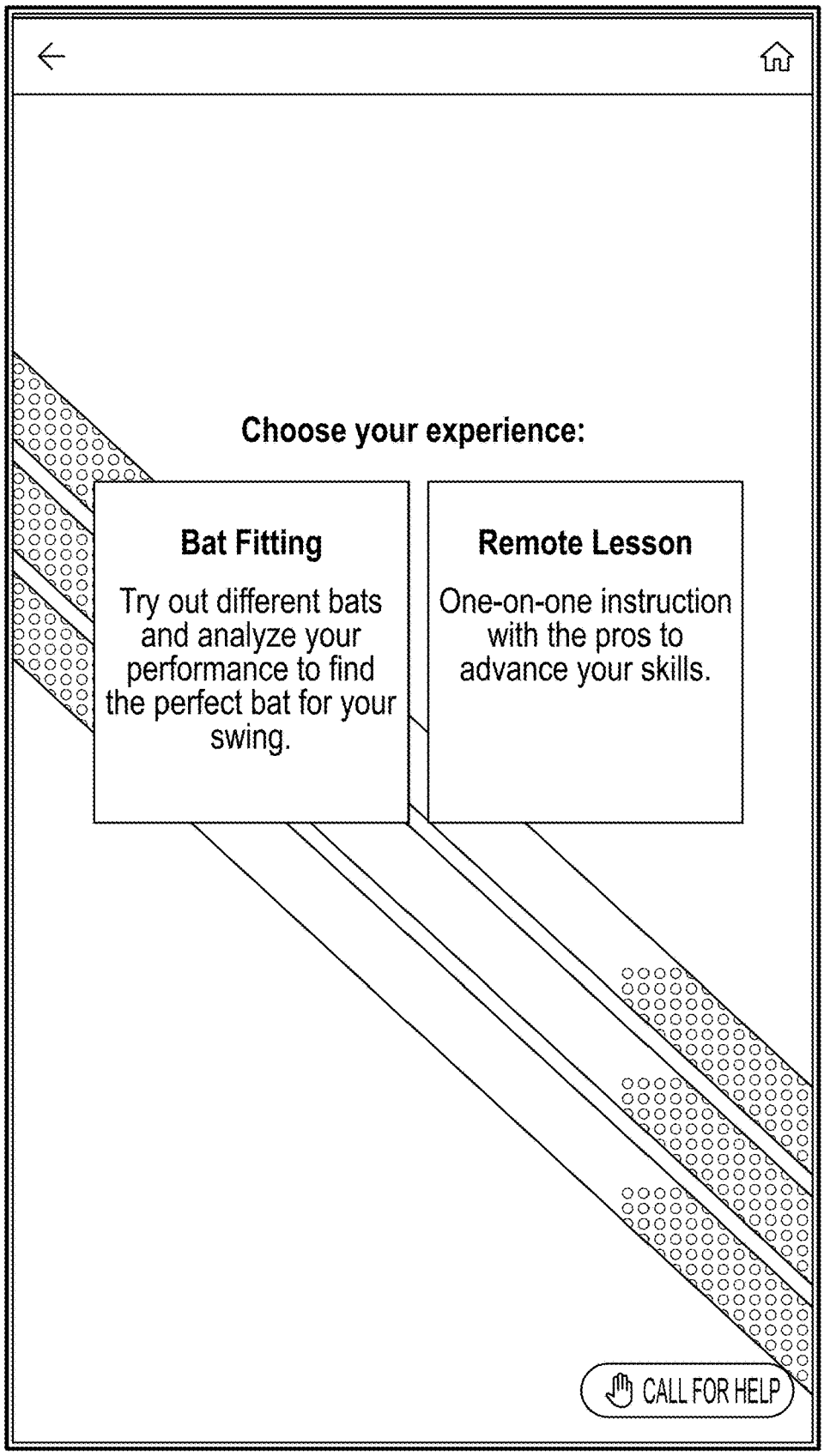
FIG. 5 is a user interface for use in providing a selection of a mode pertaining to the flexible sports bay illustrated in FIG. 3, according to some embodiments.

FIG. 5 depicts an example user interface, according to some embodiments. The user interface can include at least one icon and/or visual display. The user interface shown in FIG. 5 can be presented, generated, and/or display responsive to the user selecting at least one of the icons shown in FIG. 4. For example, the user interface can be displayed as a pop-up window responsive to the user selecting the baseball icon as shown in FIG. 4. The user interface shown in FIG. 5 can include at least one icon and/or visual display. The icons can pertain to and/or be associated with at least one mode of the flexible sports bay 302. For example, the user interface shown in FIG. 5 can include at least one icon that represents at least one mode of the flexible sports bay 302. FIG. 5 depicts an example of the user interface including an icon for the bat fitting mode and an icon for the remote lesson mode. The operator and/or the user of the terminal 205 can select at least one of the icons including the user interface shown in FIG. 5 to provide an indication of a selected mode of the flexible sports bay 302. The selection of the icon may cause the terminal 205 and/or the interaction management system 105 to configure and/or control the cameras 315 as described herein.

Figure 6:
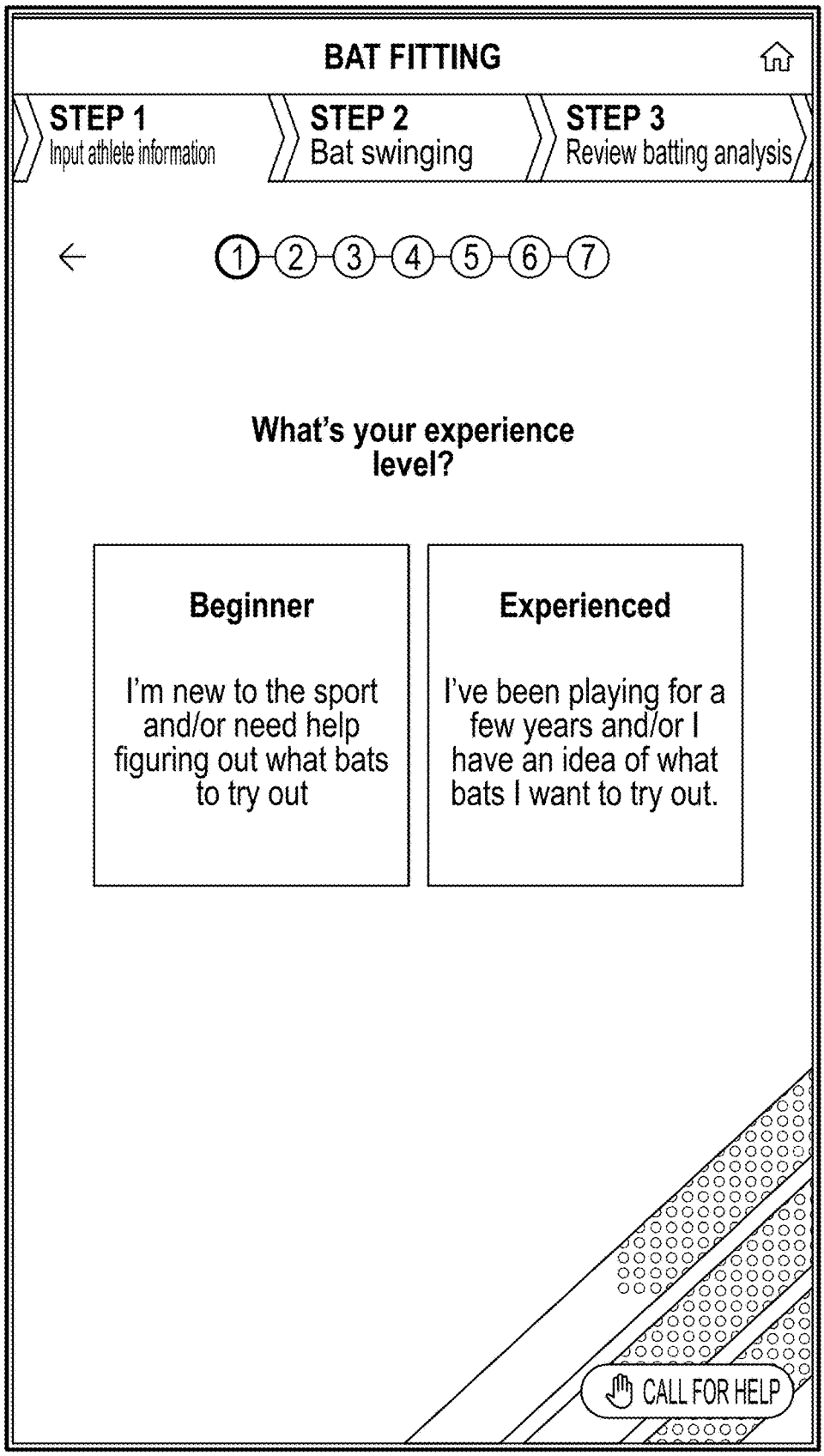
FIG. 6 is a user interface for use in providing information associated with a user of the flexible sports bay illustrated in FIG. 3, according to some embodiments.

FIG. 6 depicts an example user interface, according to some embodiments. The user interface can include at least one icon and/or visual display. The user interface shown in FIG. 6 can be presented, generated, and/or displayed responsive to the user selecting at least one of the icons shown in FIG. 5. For example, the selection of the bat fitting icon, as shown in FIG. 5, may cause the terminal 205 to generate and/or display the user interface shown in FIG. 6. The user interface can include at least one icon and the icons can be selected by the user to provide information associated with the user. FIG. 6 depicts an example of the user interface including icons that can be selected by the user to indicate an experience level of the individual that may be partaking in the selected mode of the flexible sports bay 302.

Figure 7:
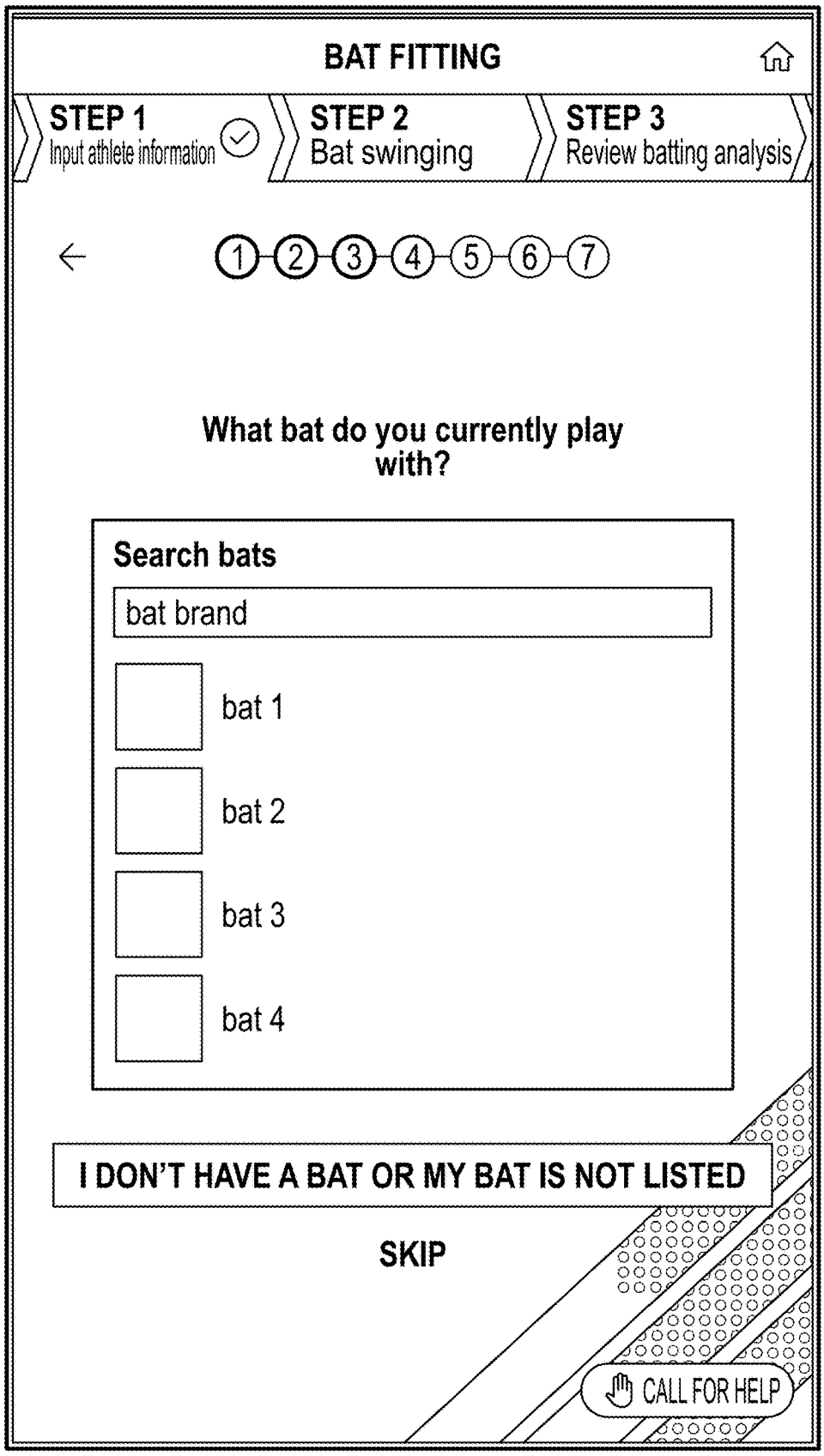
FIG. 7 is a user interface for use in providing information associated with a user of the flexible sports bay illustrated in FIG. 3, according to some embodiments.

FIG. 7 depicts an example user interface, according to some embodiments. The user interface can include at least one icon and/or visual display. The user interface shown in FIG. 7 can be presented, generated, and/or displayed responsive to the user selecting at least one of the icons shown in FIG. 6. The user interface can include at least one selectable element that a user can interact with to provide information pertaining to a piece of sports equipment. For example, the user can select an icon associated with a baseball bat to indicate, to the terminal 205, that this bat may be used during the user interactions within the flexible sports bay 302.

Figure 8:
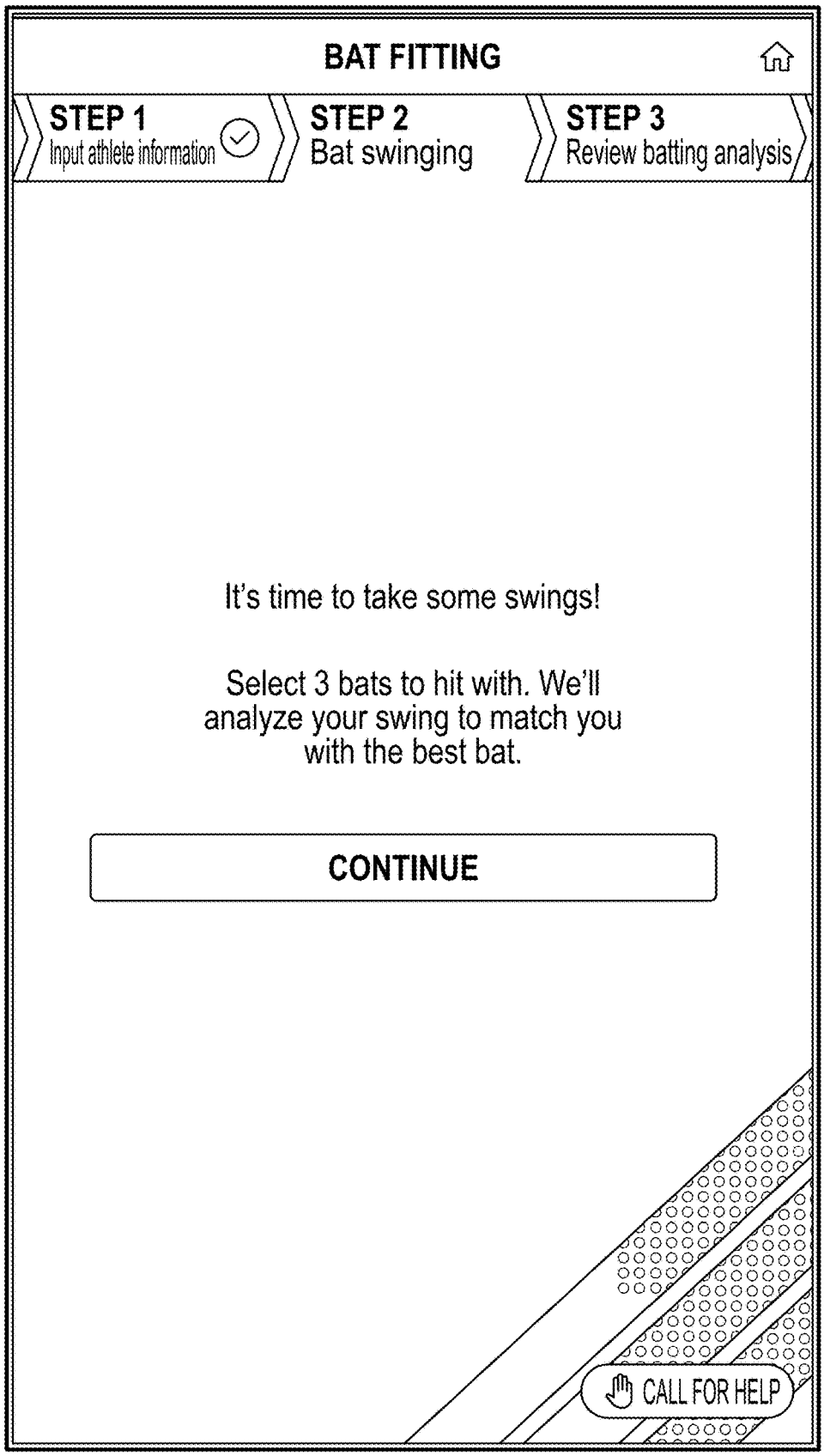
FIG. 8 is a user interface for use in initiating user interactions with the flexible sports bay illustrated in FIG. 3, according to some embodiments.

FIG. 8 depicts an example user interface, according to some embodiments. The user interface shown in FIG. 8 can be generated and/or display responsive to the user providing information to the terminal 205 pertaining to at least one mode of the flexible sports bay 302. For example, the user interface shown in FIG. 8 may be generated responsive to the user selecting the bat fitting mode of the flexible sports bay 302. The user interface shown in FIG. 8 can include at least one of a prompt, a text box, a visual cue, and/or a message providing information pertaining to the mode of the flexible sports bay 302 and/or the corresponding user interactions. FIG. 8 depicts an example of the user interface including a message that a user can select three baseball bats and that the user may then take a given number of swings using the selected bats. The user may select an icon, shown as continue icon in FIG. 8, to provide an indication to the terminal 205 that the user is set to begin user interactions.

Figure 9:
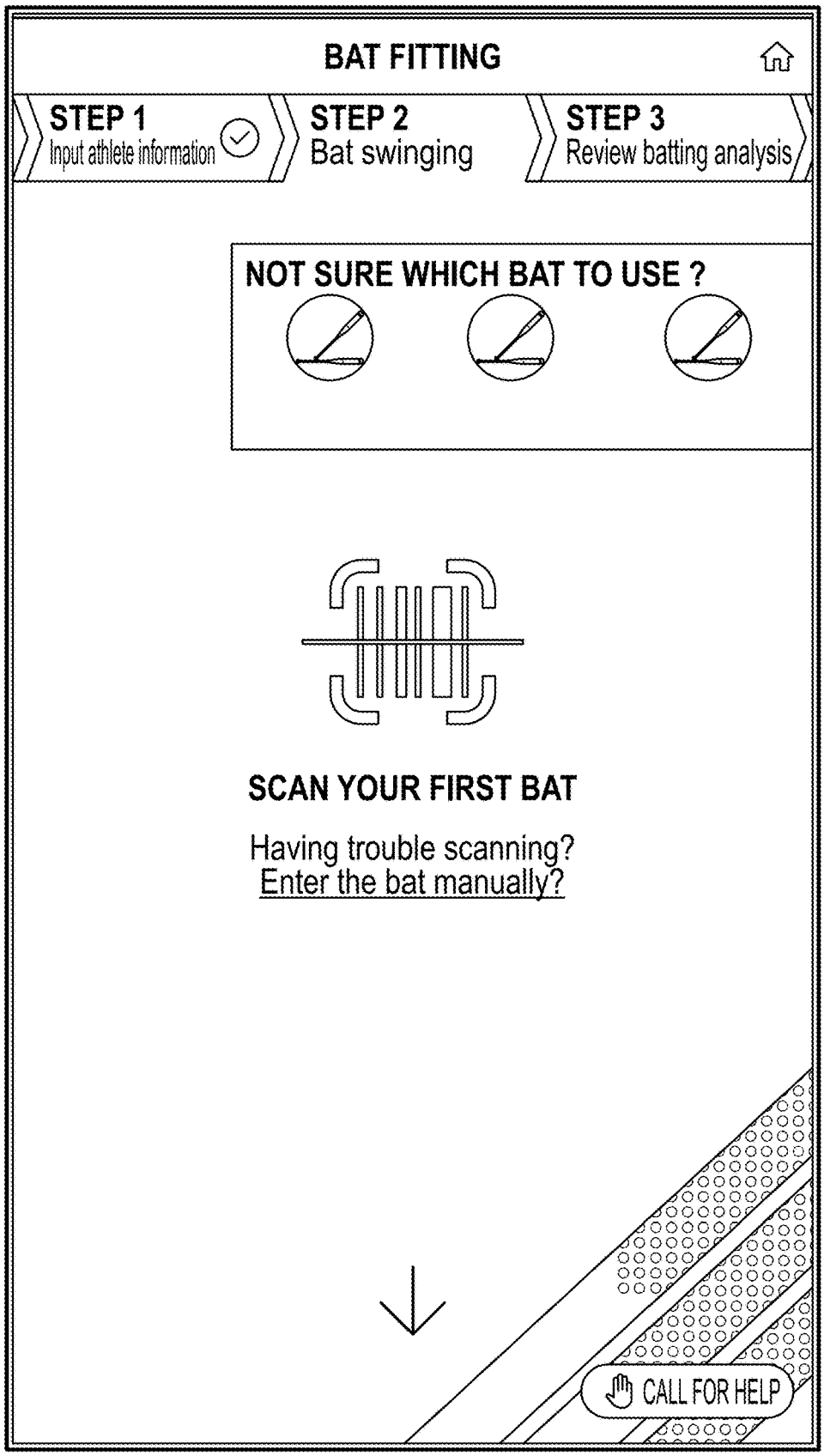
FIG. 9 is a user interface for use in providing information associated with one or more pieces of sports equipment for use in user interactions with the flexible sports bay illustrated in FIG. 3, according to some embodiments.

FIG. 9 depicts an example user interface, according to some embodiments. The user interface can be generated responsive to the user selecting the continue icon shown in FIG. 8. The user interface can include at least one of a prompt, a text box, a visual cue, and/or a message providing information. FIG. 9 depicts an example of the user interface including a message that a user can scan a bat and/or enter information associated with the bat. For example, the terminal 205 can scan a barcode on the bat. The user may also enter information associated with the bat (e.g., a model number, a serial number, a brand name, etc.)

Figure 10:
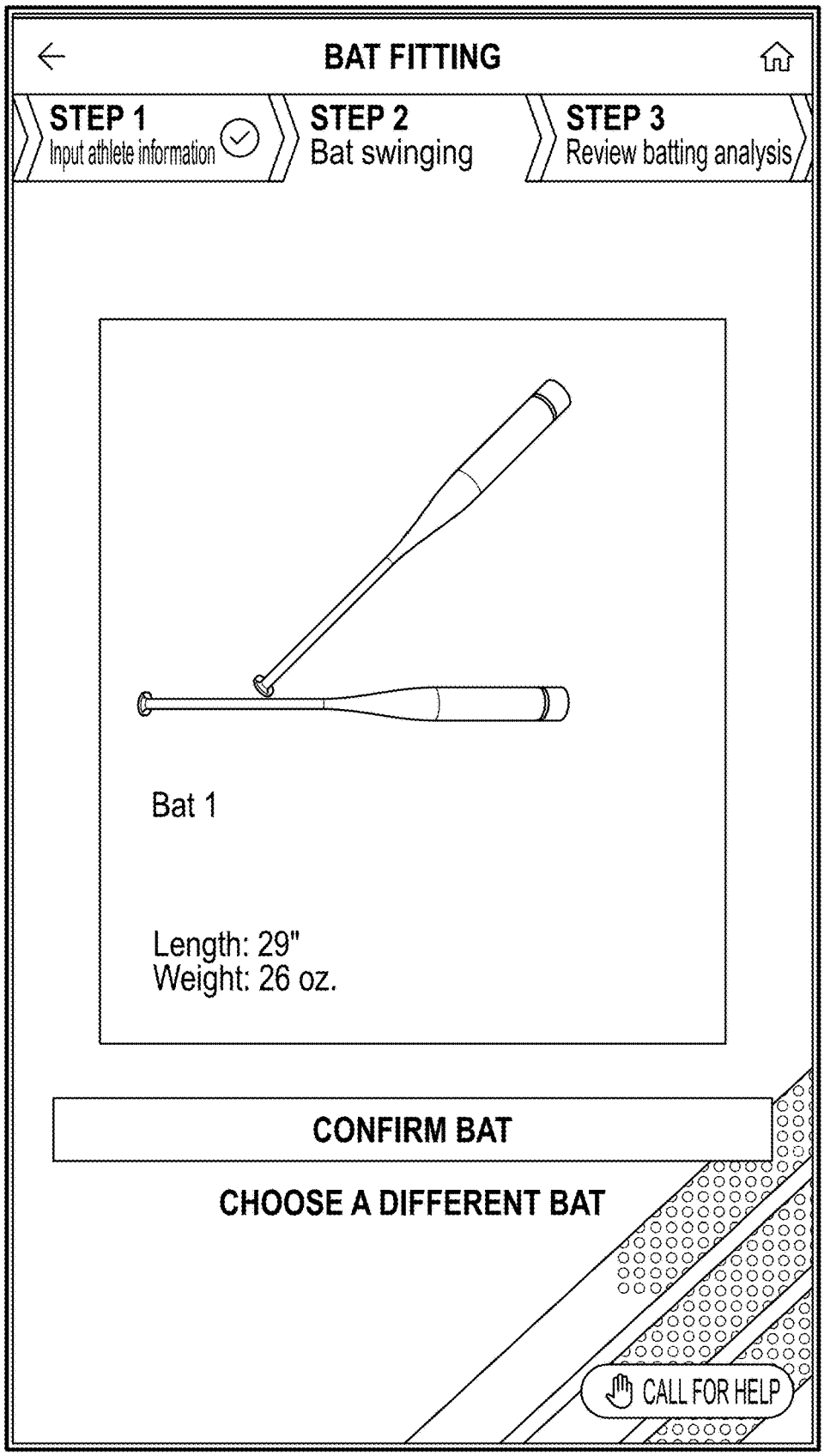
FIG. 10 is a user interface for use in providing information associated with one or more pieces of sports equipment for use in user interactions with the flexible sports bay illustrated in FIG. 3, according to some embodiments.

FIG. 10 depicts an example user interface, according to some embodiments. The user interface can be generated responsive to the user scanning and/or providing information pertaining to at least one bat. The user interface can include a graphical representation (e.g., a picture) of the bat. The graphical representation can include various information pertaining to the bat. The user can select at least one icon included in the user interface. For example, the user can select an icon to confirm the bat and/or the user can select an icon to pick a different bat.

Figure 11:
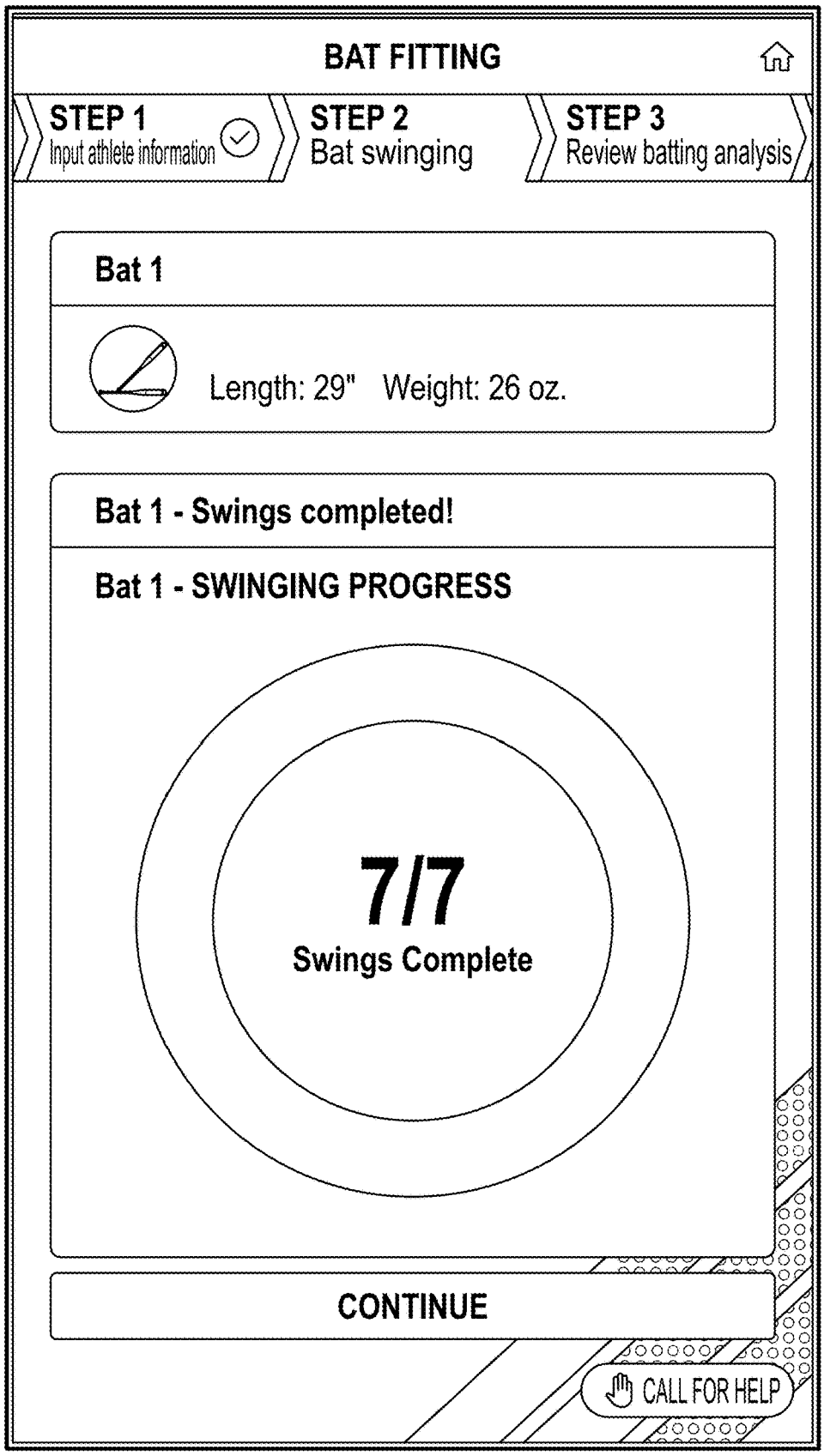
FIG. 11 is a user interface for use in tracking information obtained pertaining to user interactions with the flexible sports bay illustrated in FIG. 3, according to some embodiments.

FIG. 11 depicts an example user interface, according to some embodiments. The user interface can be generated responsive to the user indicating that they would like to initiate the user interactions pertaining to a selected mode of the flexible sports bay 302. For example, the user may select an icon displayed in at least one of the user interfaces described herein to provide an indication that they are ready to start their user interactions. The user interface shown in FIG. 11 can include a visual indicator of the progress pertaining to the user interactions. For example, the user interface can include a swing tracker that provides an indication of the number of swings performed by the user. The user interface can also include information pertaining to the bat that is being used. The terminal 205 can group the user interactions (e.g., the swings) with the bat that is being used.

Figure 12:
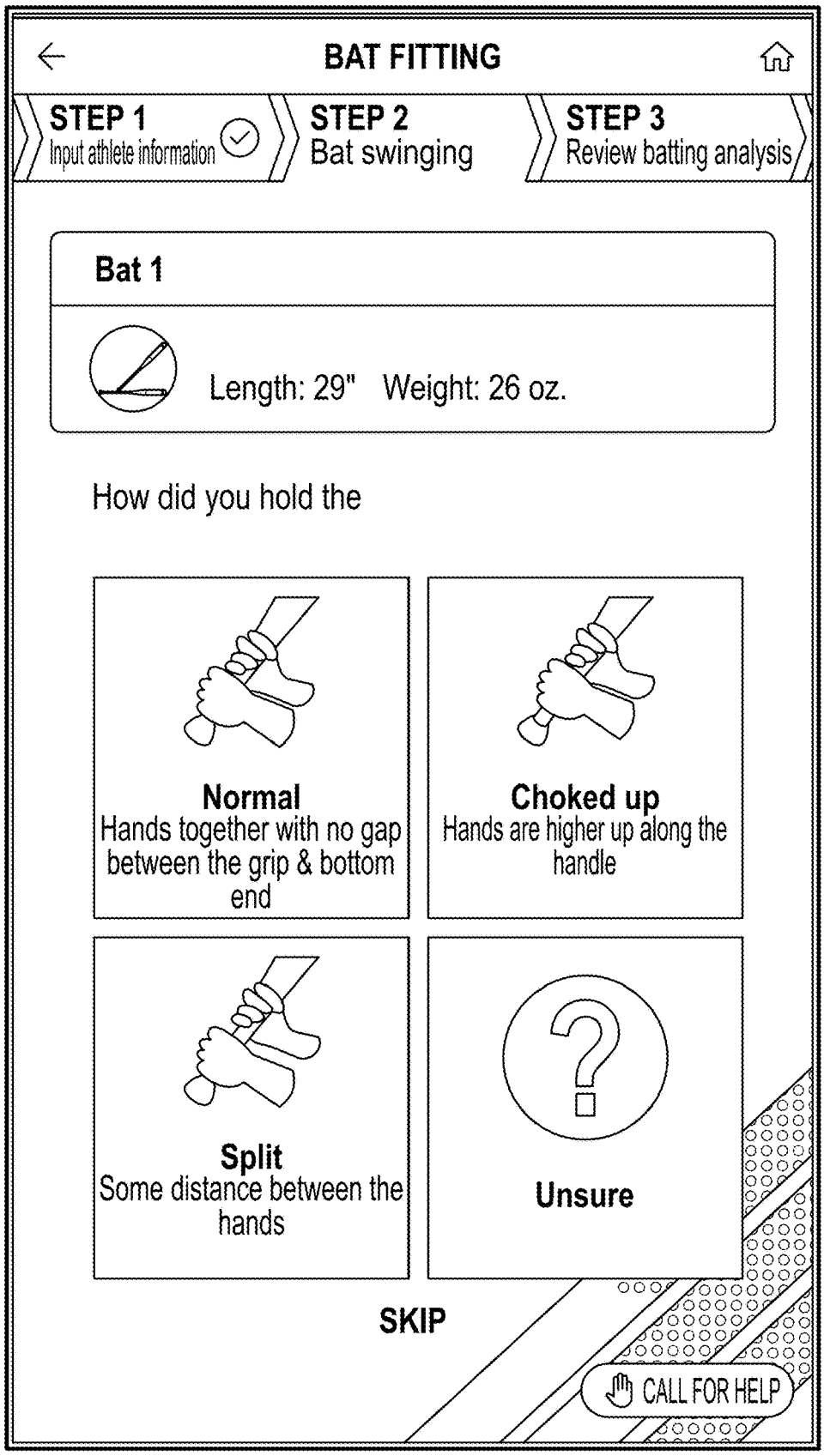
FIG. 12 is a user interface for use in providing information pertaining to one or more aspects of user interactions with the flexible sports bay illustrated in FIG. 3, according to some embodiments.

FIG. 12 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 12 can include at least one icon and the icons can be selected by the user of the terminal 205 to provide information associated with the user interactions. For example, the user can select the icons to indicate how the baseball bat was held during the baseball swings.

Figure 13:
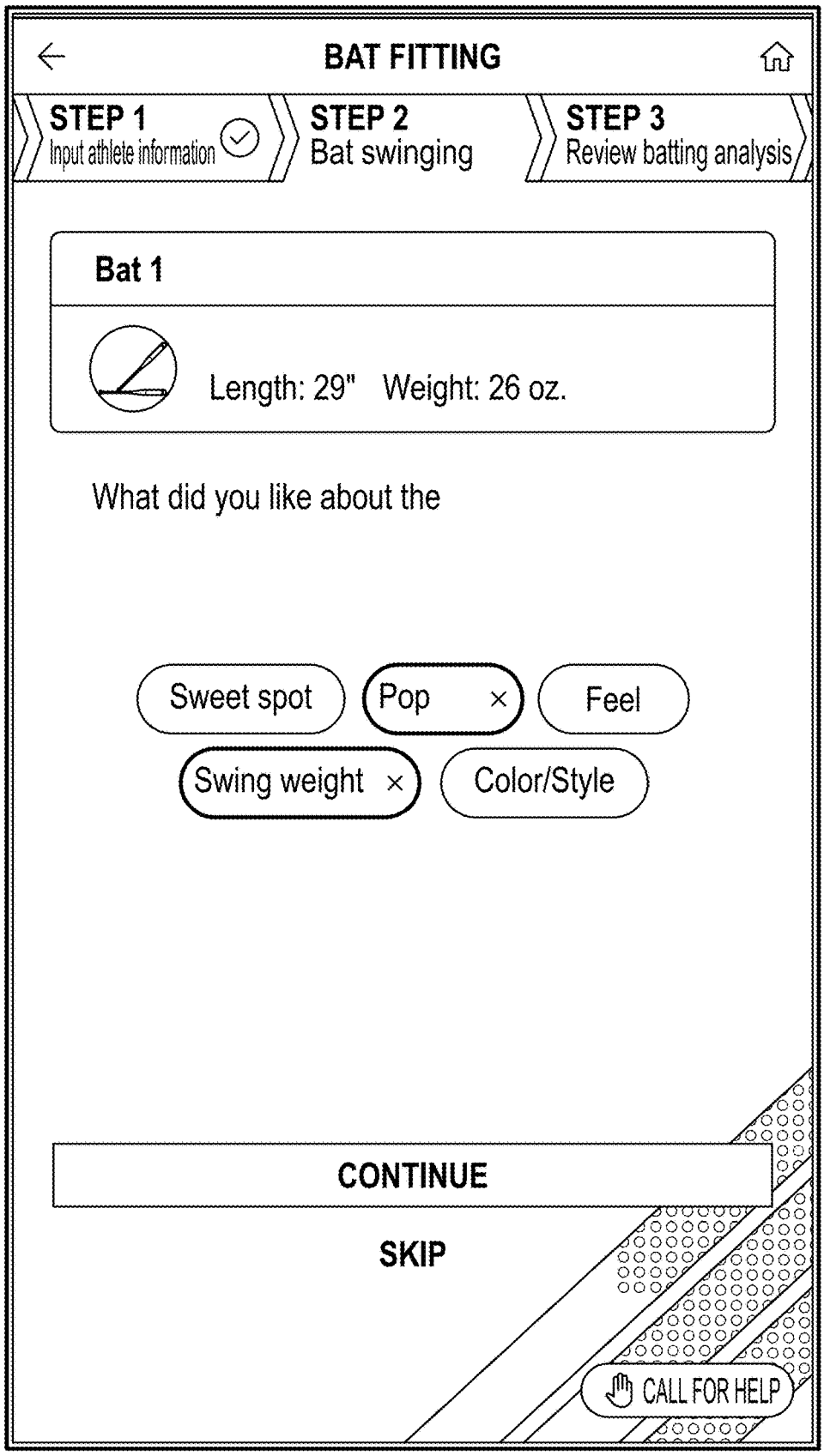
FIG. 13 is a user interface for use in providing information pertaining to one or more aspects of user interactions with the flexible sports bay illustrated in FIG. 3, according to some embodiments.

FIG. 13 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 13 can include at least one icon and the icons can be selected by the user of the terminal 205 to provide information associated with the user interactions. For example, the user can select the icons to indicate how the user perceived the user interactions when using the baseball bat. FIG. 13 depicts an example of the user interface including icons that can be selected to indicate given aspects of the baseball bat that the user enjoyed while swinging the baseball bat.

Figure 14:
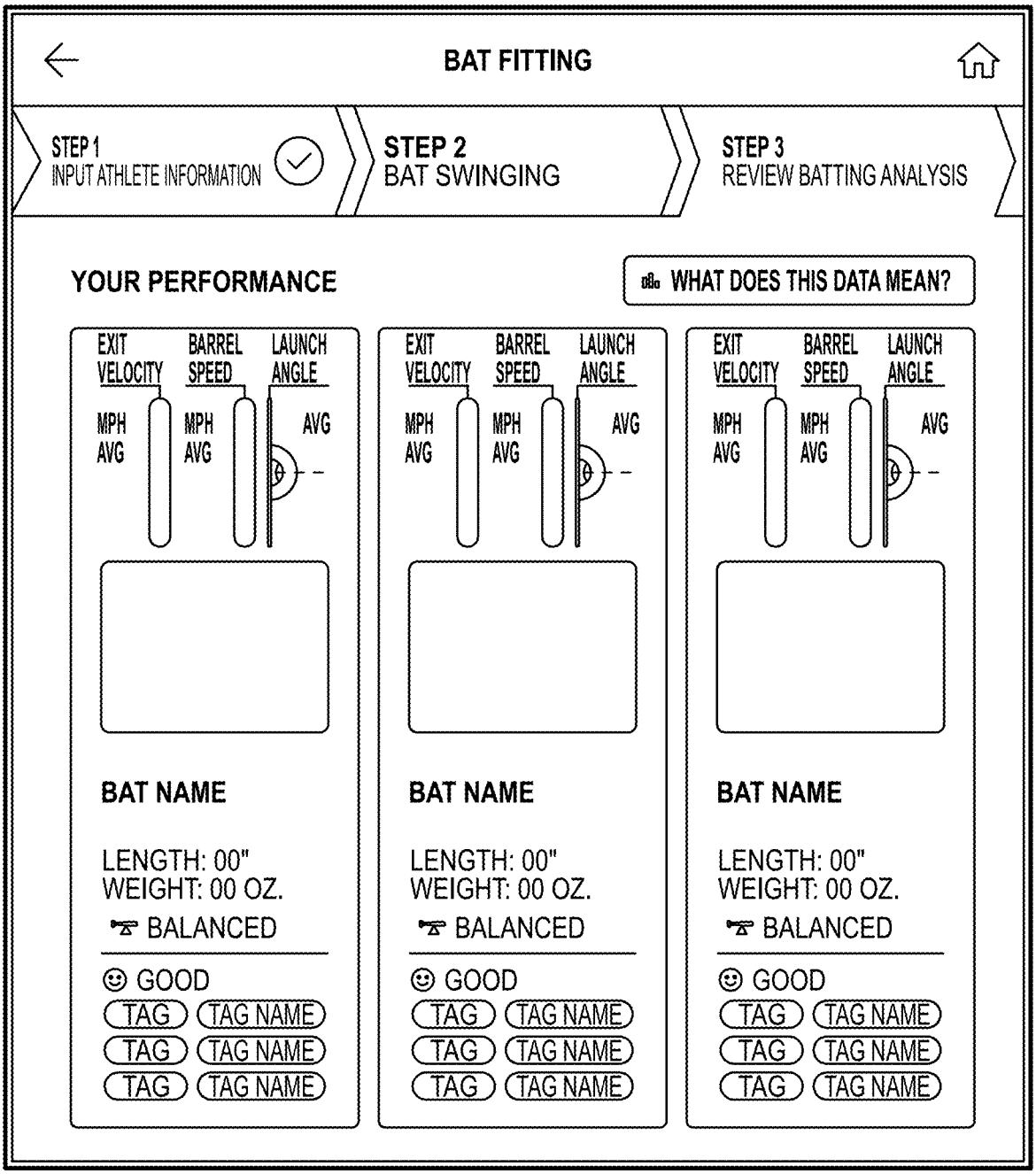
FIG. 14 is a user interface for use in providing information pertaining to one or more aspects of user interactions with the flexible sports bay illustrated in FIG. 3, according to some embodiments.

FIG. 14 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 14 can include information that was collected by the cameras 315. For example, the cameras 315 can collect performance metric information and the performance metric information can be included in the user interface. FIG. 14 depicts an example of the user interface including information that is organized and/or separated based on the baseball bats. For example, the performance metrics for each baseball bat may be included in separate boxes and/or elements of the user interface.

Figure 15:
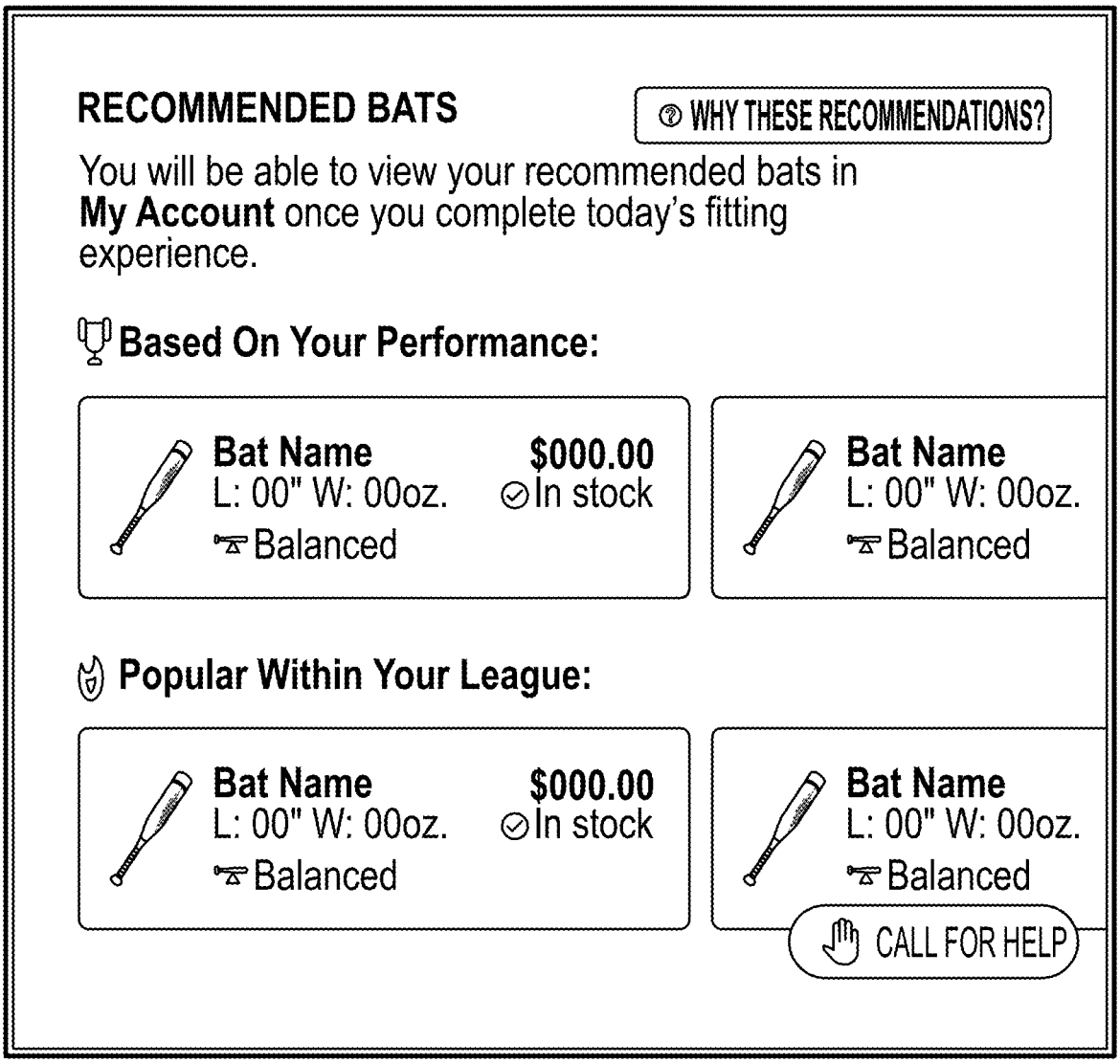
FIG. 15 is a user interface for use in providing information obtained pertaining to user interactions with the flexible sports bay illustrated in FIG. 3, according to some embodiments.

FIG. 15 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 15 can be generated responsive to the terminal 205 and/or the interaction management system 105 completing an analysis of the user interactions. For example, the terminal 205 can analyze the performance metrics associated with each baseball bat that was used during the user interactions. The terminal 205 can provide one or more recommendations based on the analysis. FIG. 15 depicts an example of the user interface including baseball bat recommendations. The baseball bat recommendations may include baseball bats that the user excelled in using during the user interactions. The recommendation may also include bats that meet a predetermined threshold.

FIG. 16 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 16 may correspond to a given baseball bat. For example, the user interface shown in FIG. 16 may include information that corresponds to a baseball bat used during a user interaction. The information shown in FIG. 16 may also include information similar to that shown in FIG. 14. The user interface shown in FIG. 16 may also be generated responsive to the user selecting one of the boxes included in the user interface shown in FIG. 14.

FIG. 17 depicts an example user interface, according to some embodiments. The user interface can be generated responsive to completion of the user interactions. For example, the user interface may be generated responsive to the user completing a given number of baseball swings. The user interface may also be generated responsive to the user selecting an icon display by the terminal 205. The user interface shown in FIG. 17 can include a summary view of the user interactions. For example, the user interface can include the baseball bats that were used during the user interactions and the user interface can include various performance metrics associated with the user interactions.

Figure 18:
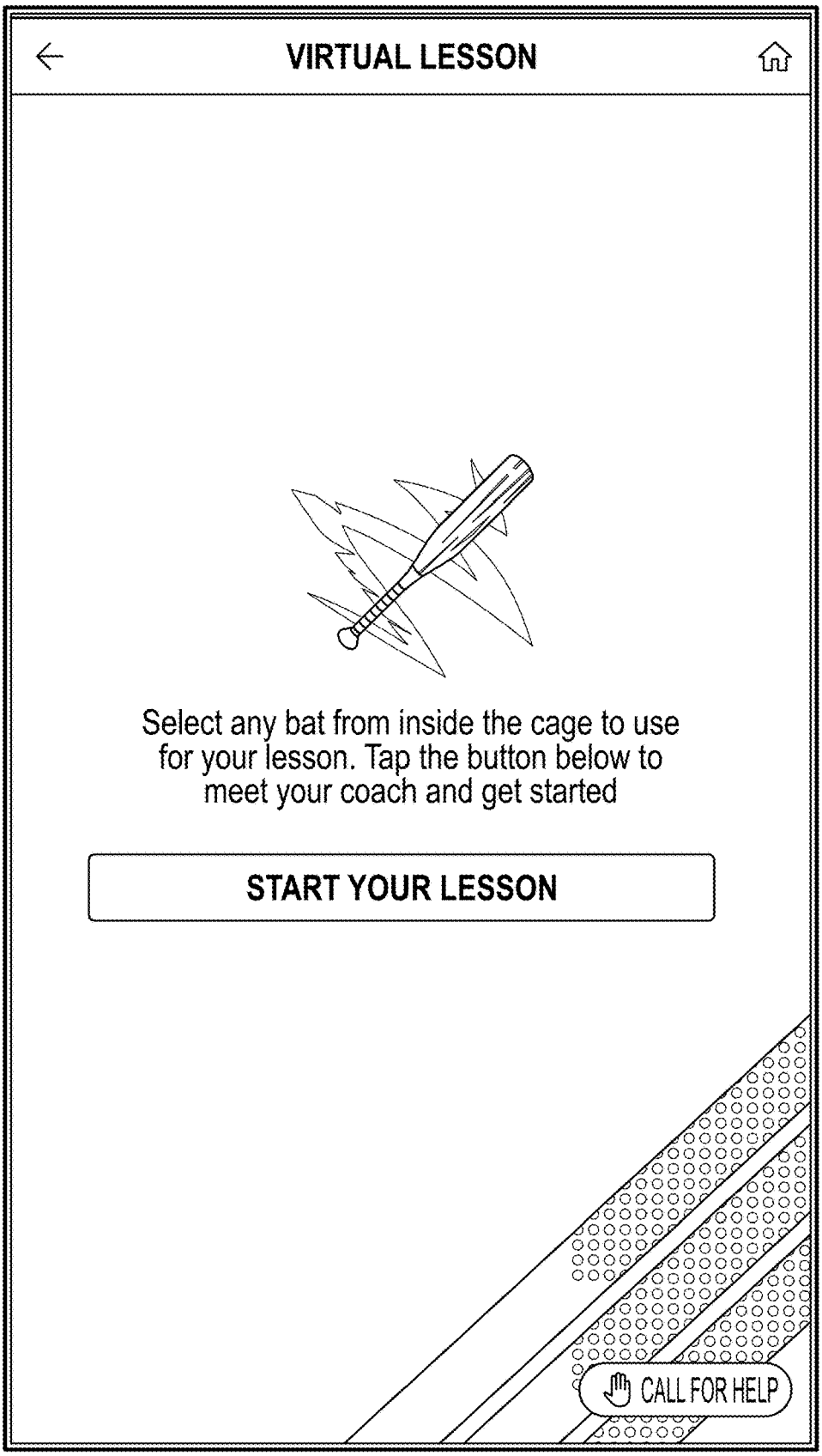
FIG. 18 is a user interface for use in initiating a user session with the flexible sports bay illustrated in FIG. 3, according to some embodiments.

FIG. 18 depicts an example user interface, according to some embodiments. The user interface shown in FIG. 18 may be used by an operator and/or a user of the terminal 205 to provide an indication that they user would like to start a virtual lesson (e.g., a remote lesson mode). The virtual lesson can be and/or include at least one of a guided baseball hitting lesson, a guided baseball skill lesson, a swing analysis lesson, and/or among various possible combinations. FIG. 18 depicts an example of the user interface including an icon, shown as start your lesson icon, and the selection of the icon may cause the terminal 205 to determine that a given mode (e.g., the remote lesson mode) of the flexible sports bay 302 was selected. The selection may cause the terminal 205 to control and/or configure the cameras 315 to perform various operations pertaining to the selected mode of the flexible sports bay 302.

Figure 19:
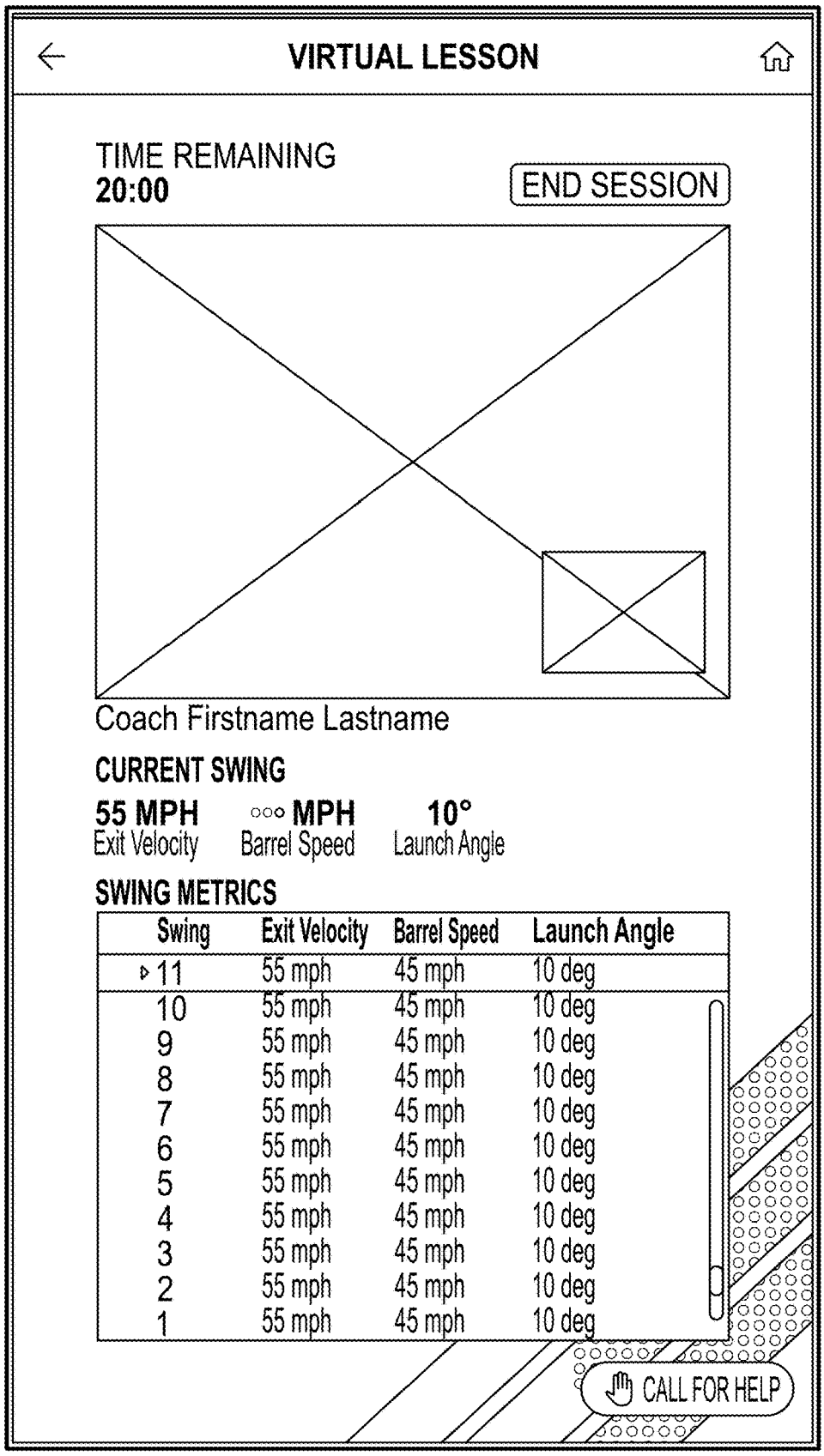
FIG. 19 is a user interface for use in tracking information obtained during a user session with the flexible sports bay illustrated in FIG. 3, according to some embodiments.

FIG. 19 depicts an example user interface, according to some embodiments. The user interface shown in FIG. 19 may be used by an operator and/or a user of the terminal 205 to perform, conduct, and/or otherwise partake in a virtual lesson via the remote lesson mode. The user interface shown in FIG. 19 may be generated responsive to the user providing an indication that they would like to partake in the virtual lesson. The user interface shown in FIG. 19 can include information collected by the cameras 315. For example, the user interface can include performance metrics that were captured by the cameras 315. The user interface shown in FIG. 19 can also include a window and/or region including a video feed of the instructor and/or the user (e.g., the individual partaking in the virtual lesson).

Figure 20:
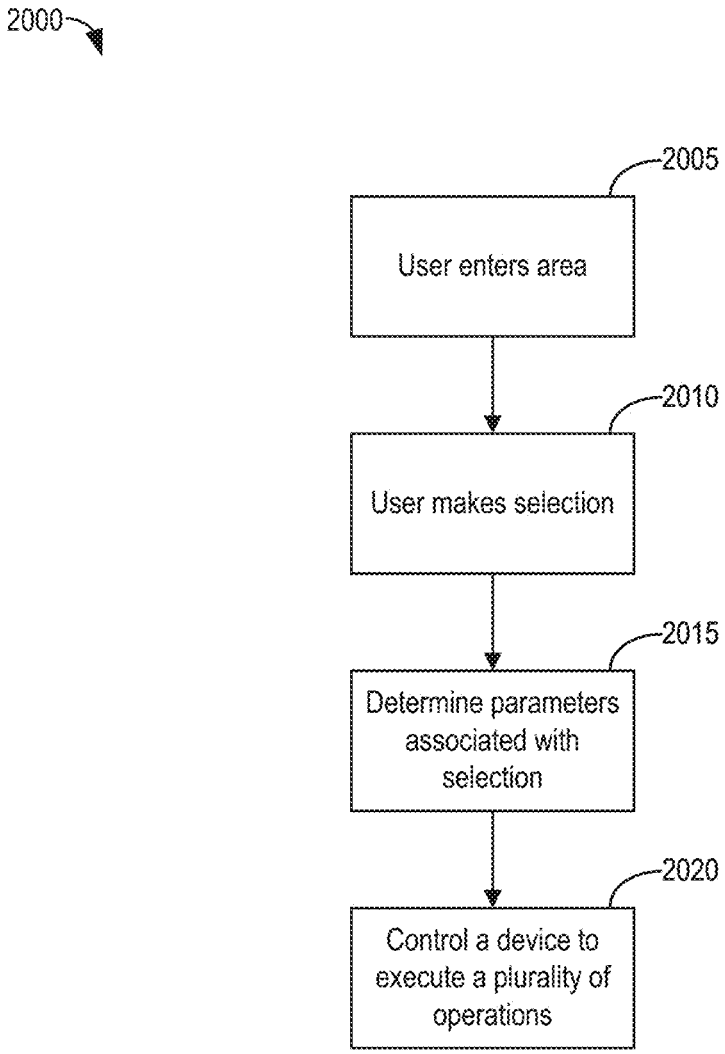
FIG. 20 is a flow diagram of a process of controlling a functionality of the flexible sports bay illustrated in FIG. 3, according to some embodiments.

FIG. 20 depicts a flow diagram of a process 2000 for providing various modes of a flexible sports bay, according to some embodiments. The flexible sports bay can be and/or include the flexible sports bay 302. The various modes can be and/or include at least one of the modes and/or user interactions described herein. At least one step of the process 2000 can be performed by various systems, devices, and/or components described herein. For example, at least one step of the process 2000 can be performed by the terminal 205.

At step 2005, a user can enter an area. For example, a user can enter the flexible sports bay 302. The user can enter the flexible sports bay 302 by at least one of orienting, placing, locating, and/or otherwise positioning themselves within and/or proximate to the flexible sports bay 302. The cameras 315 can detect, identify, and/or otherwise determine that the user entered the flexible sports bay 302. The terminal 205 can determine that the user entered the flexible sports bay 302 responsive to the user interacting with the flexible sports bay 302.

At step 2010, the user can make a selection. For example, the user can select at least one mode of the flexible sports bay 302. The user can make the selection by interfacing with, interacting with, and/or otherwise engaging with the terminal 205. For example, the user can interface with the terminal 205 by selecting an icon included in a user interface displayed by the terminal 205.

At step 2015, parameters associated with the selection can be determined. For example, the terminal 205 can determine parameters associated with the mode selected in step 2020. The parameters can pertain to the user interactions that are associated with the selected mode. The parameters can also pertain to operations performed by the cameras 315. For example, the parameters can indicate given actions that the cameras 315 can perform during the user interactions.

At step 2020, a device to execute a plurality of operations can be controlled. For example, the terminal 205 can provide control signal to the cameras 315 (e.g., the device) and the control signals can cause the cameras 315 to perform operations. The operations performed by the cameras 315 can be based on the parameters determined in step 2015. The operations can also be associated with and/or pertain to the user interactions corresponding to the selected mode in step 2010. For example, if the mode selected in step 2010 was for a bat fitting the operations performed by the cameras 315, in step 2020, may include a first set of operations. To continue this example, the mode selected in step 2010 was for a soccer cleat fitting the operations performed by the cameras 315, in step 2020, may include a second set of operations. The first set of operations may include operations that are different from the second set of operations.

Figure 21:
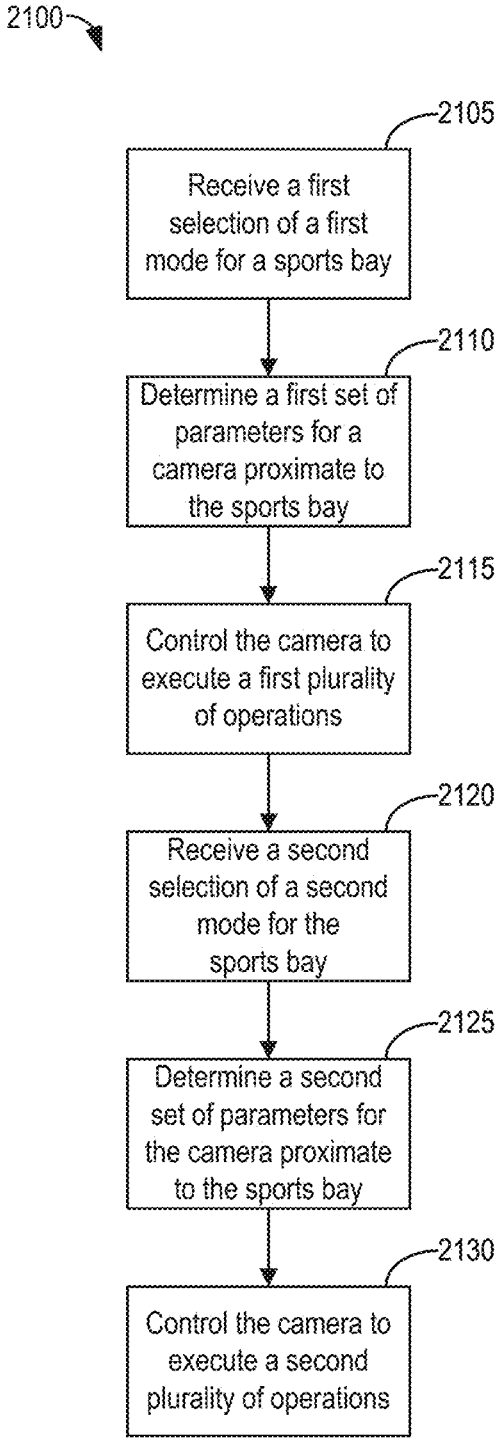
FIG. 21 is a flow diagram of a process of switching between modes of the flexible sports bay illustrated in FIG. 3, according to some embodiments.

FIG. 21 depicts a flow diagram of a process 2100 of switching between modes of a flexible sports bay. The flexible sports bay can be and/or include the flexible sports bay 302. As described herein, the flexible sports bay 302 can include, implement, and/or otherwise provide various modes (e.g., bat selection mode, virtual training mode, remote lesson mode, sport instruction mode, cleat selection mode, among various other combinations and/or alternatives). In some embodiments, the process 2100 and/or the corresponding steps can be performed to modify, adjust, alter, and/or otherwise switch the flexible sports bay 302 and/or a component thereof between one or more modes of the flexible sports bay 302. At least one step of the process 2100 can be performed by various systems, devices, and/or components described herein. For example, at least one step of the process 2100 can be performed by the terminal 205. In some embodiments, the terminal 205 can perform at least one step of the process 2100 to modify, adjust, alter, and/or otherwise change operating settings and/or configuration settings for at least one of the sensors 135 and/or the cameras 315.

At step 2105, a first selection of a first mode for a sports bay can be received. The first selection can be received by the terminal 205. For example, the terminal 205 can receive the selection of the first mode responsive to a user and/or an operator of the terminal 205 interfacing with a user interface displayed by terminal 205. The operator of the terminal 205 can interface with the user interface by at least one of contacting, interacting with, engaging with, and/or otherwise selecting at least one element and/or portion of the user interface. For example, the operator can select an icon pertaining to a first mode of the flexible sports bay 302. The terminal 205 can receive, responsive to the operator selecting the icon, the selection of the first mode. The first mode can be and/or include at least one of the various modes described herein. For example, the first mode can be the bat selection mode described herein.

At step 2110, a first set of parameters for a camera proximate to the sports bay can be determined. For example, the terminal 205 can determine parameters for the camera 315. The first set of parameters can be and/or include the operating parameters described herein. The terminal 205 can determine the first set of parameters for the camera 315 based on the first mode received in step 2105. For example, the first mode can be the soccer cleat selection mode and terminal 205 can determine the parameters for the camera based on the soccer cleat selection mode. In some embodiments, the terminal 205 can determine the parameters for the camera 315 based on at least one of the aspects of the user interactions pertaining to the selected mode, information that may be used to evaluate the user interactions, and/or one or more actions that can be performed to capture information associated with the selected mode. For example, the terminal 205 can determine that the bat selection mode includes collecting launch angle information and the terminal 205 can determine, for the cameras 315, parameters pertaining to collection launch angle information.

At step 2115, the camera can be controlled to execute a first plurality of operations. For example, the terminal 205 can provide control signals, to the cameras 315, that cause the cameras 315 to perform operations. The operations performed by the cameras 315 can be based on the first set of parameters determined in step 2110. For example, the terminal 205 can generate control signals including the operating parameters pertaining to the selected mode of the flexible sports bay 302 and the terminal 205 providing the control signals, to the cameras 315, can cause the cameras 315 to perform operations based on the operating parameters.

At step 2120, a second selection of a second mode for the sports bay can be received. For example, the terminal 205 can receive a selection, via a user interface displayed by the terminal 205, of a second mode of the flexible sports bay 302. The second mode can be different from the first mode. For example, the first mode can be the soccer cleat selection mode and the second mode can be the remote lesson mode).

At step 2125, a second set of parameters for the camera proximate to the sports bay can be determined. For example, the terminal 205 can determine parameters for the cameras 315 that pertain to the second mode selected in step 2120. The second set of parameters can be and/or include the operating parameters described herein. The terminal 205 can determine the second set of parameters responsive to receiving the selection of the second mode of the flexible sports bay 302. The terminal 205 can determine the second set of parameters based on the second mode. For example, the terminal 205 can determine the second set of parameters based on the user interactions that are associated with the second mode of the flexible sports bay 302.

At step 2130, the camera can be controlled to execute a second plurality of operations. For example, the terminal 205 can provide control signals, to the cameras 315, that cause the cameras 315 to perform operations associated with the second mode received in step 2120. The second plurality of operations can be based on the second set of parameters determined in step 2125. For example, the second set of parameters can include and/or otherwise define types of information to be gathered during the user interactions associated with the second mode and the control signals can cause the cameras 315 to gather the information defined by the second set of parameters.

In some embodiments, at least one of the modes of the flexible sports bay 302 can be an equipment testing mode that can be used to test equipment for at least one sport. For example, the first mode can be the bat selection mode and the bat selection mode can be used to test bats (e.g., equipment) for baseball. In some embodiments, at least one of the modes of the flexible sports bay 302 can be a remote lesson mode that can be used to conduct a remote training session with an offsite instructor. For example, the second mode can be the remote lesson mode and the remote lesson mode can be used to conduct virtual training sessions (e.g., the remote training sessions with the offsite instructor.

In some embodiments, at least one of the modes of the flexible sports bay 302 can be and/or include at least one of an equipment test mode and/or a remote lesson mode. For example, the first mode can be at least one of the equipment test mode and/or the remote lesson mode training mode. The equipment test mode can be and/or include at least one of the various equipment modes described herein (e.g., bat selection, soccer cleat selection, etc.). The remote lesson mode can be at least one of the training modes described herein.

While this specification contains many specific implementation details, these should not be construed as limitations on the scope of any inventions or of what may be claimed, but rather as descriptions of features specific to particular implementations of the systems and methods described herein. Certain features that are described in this specification in the context of separate implementations can also be implemented and/or arranged in combination in a single implementation. Conversely, various features that are described in the context of a single implementation can also be implemented and arranged in multiple implementations separately or in any suitable sub combination. Moreover, although features may be described above as acting in certain combinations and even initially claimed as such, one or more features from a claimed combination can in some cases be excised from the combination, and the claimed combination may be directed to a subcombination or variation of a subcombination.

Additionally, features described with respect to particular headings may be utilized with respect to and/or in combination with illustrative implementations described under other headings; headings, where provided, are included solely for the purpose of readability, and should not be construed as limiting any features provided with respect to such headings.

Similarly, while operations are depicted in the drawings in a particular order, this should not be understood as requiring that such operations be performed in the particular order shown or in sequential order, or that all illustrated operations be performed, to achieve desirable results. In some cases, the actions recited in the claims can be performed in a different order and still achieve desirable results. In addition, the processes depicted in the accompanying figures do not necessarily require the particular order shown, or sequential order, to achieve desirable results.

In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Having now described some illustrative implementations, implementations, illustrative embodiments, and embodiments, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements, and features discussed only in connection with one implementation are not intended to be excluded from a similar role in other implementations.

The phraseology and terminology used herein is for the purpose of description and should not be regarded as limiting. The use of "including," "comprising," "having," "containing," "involving," "characterized by," "characterized in that," and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations, arrangements, elements, or acts of the systems and methods herein referred to in the singular may also embrace implementations including a plurality of these elements, and any references in plural to any implementation, arrangement, element, or act herein may also embrace implementations including only a single element. References in the singular or plural form are not intended to limit the presently disclosed systems or methods, or their components, acts, or elements to single or plural configurations. References to any act or element being based on any information, act, or element may include implementations where the act or element is based at least in part on any information, act, or element.

Any implementation disclosed herein may be combined with any other implementation, and references to "an implementation," "some implementations," "an alternate implementation," "various implementation," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms.

Where technical features in the drawings, detailed description, or any claim are followed by reference signs, the reference signs have been included for the sole purpose of increasing the intelligibility of the drawings, detailed description, and claims. Accordingly, neither the reference signs nor their absence have any limiting effect on the scope of any claim elements.

It should be understood that no claim element herein is to be construed under the provisions of 35 U.S.C. § 112(f) unless the element is expressly recited using the phrase "means for."

As used herein, the term "circuit" may include hardware structured to execute the functions described herein. In some embodiments, each respective "circuit" may include machine-readable media for configuring the hardware to execute the functions described herein. The circuit may be embodied as one or more circuitry components, including, but not limited to, processing circuitry, network interfaces, peripheral devices, input devices, output devices, and sensors. In some embodiments, a circuit may take the form of one or more analog circuits, electronic circuits (e.g., integrated circuits (IC), discrete circuits, system on a chip (SOC) circuits), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR), resistors, multiplexers, registers, capacitors, inductors, diodes, wiring.

The "circuit" may also include one or more processors communicatively coupled to one or more memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively, or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor), microprocessor. In some embodiments, the one or more processors may be external to the apparatus, for example the one or more processors may be a remote processor (e.g., a cloud based processor). Alternatively, or additionally, the one or more processors may be internal and/or local to the apparatus. In this regard, a given circuit or components thereof may be disposed locally (e.g., as part of a local server, a local computing system) or remotely (e.g., as part of a remote server such as a cloud based server). To that end, a "circuit" as described herein may include components that are distributed across one or more locations.

An exemplary system for implementing the overall system or portions of the embodiments might include a general purpose computing devices in the form of computers, including a processing unit, a system memory, and a system bus that couples various system components including the system memory to the processing unit. Each memory device may include non-transient volatile storage media, non-volatile storage media, non-transitory storage media (e.g., one or more volatile and/or non-volatile memories), etc. In some embodiments, the non-volatile media may take the form of ROM, flash memory (e.g., flash memory such as NAND, 3D NAND, NOR, 3D NOR), EEPROM, MRAM, magnetic storage, hard discs, optical discs, etc. In other embodiments, the volatile storage media may take the form of RAM, TRAM, ZRAM, etc. Combinations of the above are also included within the scope of machine-readable media. In this regard, machine-executable instructions comprise, for example, instructions and data which cause a general purpose computer, special purpose computer, or special purpose processing machines to perform a certain function or group of functions. Each respective memory device may be operable to maintain or otherwise store information relating to the operations performed by one or more associated circuits, including processor instructions and related data (e.g., database components, object code components, script components), in accordance with the example embodiments described herein.

It should also be noted that the term "input devices," as described herein, may include any type of input device including, but not limited to, a keyboard, a keypad, a mouse, joystick or other input devices performing a similar function. Comparatively, the term "output device," as described herein, may include any type of output device including, but not limited to, a computer monitor, printer, facsimile machine, or other output devices performing a similar function.

Any foregoing references to currency or funds are intended to include fiat currencies, non-fiat currencies (e.g., precious metals), and math-based currencies (often referred to as cryptocurrencies). Examples of math-based currencies include Bitcoin, Litecoin, Dogecoin, and the like.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure as defined in the appended claims. Such variations will depend on the machine-readable media and hardware systems chosen and on designer choice. It is understood that all such variations are within the scope of the disclosure. Likewise, software and web implementations of the present disclosure could be accomplished with standard programming techniques with rule-based logic and other logic to accomplish the various database searching steps, correlation steps, comparison steps, and decision steps.

What is claimed is:

1. A sports bay, comprising:

a terminal, the terminal including one or more memory devices storing instructions thereon that, when executed by one or more processors, cause the one or more processors to:

receive, via one or more inputs provided to a display of the terminal, a first indication of a selection of a plurality of pieces of sports equipment, the one or more inputs including information to identify the plurality of pieces of sports equipment;

provide, via the display of the terminal, a first prompt for a user to initiate execution of a plurality of interactions between the user and an object, wherein the user utilizes at least one piece of sports equipment of the plurality of pieces of sports equipment to execute the plurality of interactions responsive to the first prompt being provided via the display;

determine, responsive to execution of the plurality of interactions, a plurality of characteristics to indicate a first performance of the user when utilizing the at least one piece of sports equipment of the plurality of pieces of sports equipment;

receive, via the display of the terminal, a characteristic to indicate a second performance of the at least one piece of sports equipment of the plurality of pieces of sports equipment;

provide, via the display of the terminal, a second prompt to indicate a first selection of the at least one piece of sports equipment of the plurality of pieces of sports equipment; and receive, via the display of the terminal, a second indication of a second selection by the user of the at least one piece of sports equipment of the plurality of pieces of sports equipment.

2. The sports bay of claim 1, wherein the characteristic is defined by the user via one or more interactions with the terminal, and wherein the instructions cause the one or more processors to:

select, responsive to a determination that a difference between the first performance and the second performance is less than a predetermined threshold, the at least one piece of sports equipment of the plurality of pieces of sports equipment; and provide the second prompt to indicate the first selection of the at least one piece of sports equipment of the plurality of pieces of sports equipment.

3. The sports bay of claim 1, further comprising:

a camera configured to obtain information associated with interactions within the sports bay; and wherein the instructions cause the one or more processors to:

receive, from the camera responsive to execution of the plurality of interactions, a first set of data corresponding to one or more aspects of the plurality of interactions;

identify, from the first set of data, information associated with the at least one piece of sports equipment of the plurality of pieces of sports equipment; and determine the plurality of characteristics using at least a portion of the information associated with the at least one piece of sports equipment.

4. The sports bay of claim 1, wherein the instructions cause the one or more processors to:

query, responsive to receipt of the second selection of the at least one piece of sports equipment, a database to identify a plurality of locations where the at least one piece of sports equipment is present;

determine, responsive to identifying the plurality of locations, that a user identified location is absent from the plurality of locations; and identify, using one or more aspects of the at least one piece of sports equipment, one or more second pieces of sports equipment.

5. The sports bay of claim 1, wherein the instructions cause the one or more processors to:

query, responsive to receipt of the second selection of the at least one piece of sports equipment, a database to identify one or more second pieces of sports equipment similar to the at least one piece of sports equipment;

provide, via the display of the terminal responsive to identification of the one or more second pieces of sports equipment, a visual representation of one or more characteristics of the one or more second pieces of sports equipment;

receive, from the display of the terminal, a third indication of a selection of the one or more second pieces of sports equipment; and provide, via the display of the terminal, information associated with one or more sources to obtain the one or more second pieces of sports equipment.

6. The sports bay of claim 1, wherein the instructions cause the one or more processors to:

prompt, responsive to receipt of the first indication of the selection of the plurality of pieces of sports equipment, the user for information to identify a plurality of criteria pertaining to usage of the plurality of pieces of sports equipment;

receive, from the display of the terminal, the information to identify the plurality of criteria;

determine, using the plurality of criteria and characteristics of the plurality of pieces of sports equipment, that at least one second piece of sports equipment of the plurality of pieces of sports equipment is excluded from consideration; and provide, via the display of the terminal, a notice to indicate exclusion of the at least one second piece of sports equipment of the plurality of pieces of sports equipment.

7. The sports bay of claim 1, wherein the instructions cause the one or more processors to:

receive, via the display of the terminal, a first selection of a mode of the sports bay;

determine, based on one or more characteristics of the mode, a set of parameters pertaining to a camera proximate to the sports bay; and control, using the set of parameters, the camera to execute a plurality of operations to obtain information associated with the plurality of interactions.

8. The sports bay of claim 7, wherein the instructions cause the one or more processors to:

receive, via the display of the terminal, a second selection of a second mode of the sports bay;

determine, based on one or more characteristics of the second mode, a second set of parameters pertaining to the camera; and control, using the second set of parameters, the camera to execute a second plurality of operations to obtain information associated with a second plurality of interactions, wherein the second plurality of operations are different than the plurality of operations.

9. The sports bay of claim 8, wherein the mode is an equipment testing mode configured to test equipment for a first sport, and wherein the second mode is a second equipment testing mode configured to test equipment for a second sport.

10. The sports bay of claim 1, wherein the instructions cause the one or more processors to:

control a camera to execute one or more first operations based on the selection of the plurality of pieces of sports equipment corresponding to a first mode of the sports bay; and control the camera to execute one or more second operations based on the selection of the plurality of pieces of sports equipment corresponding to a second mode of the sports bay.

11. A system comprising one or more memory devices storing instructions thereon that, when executed by one or more processors, cause the one or more processors to:

receive, via one or more inputs provided to a device, a first indication of a selection of a plurality of pieces of sports equipment, the one or more inputs including information to identify the plurality of pieces of sports equipment;

provide, via the device, a first prompt for a user to initiate execution of a plurality of interactions between the user and an object, wherein the user utilizes at least one piece of sports equipment of the plurality of pieces of sports equipment to execute the plurality of interactions responsive to the first prompt being provided via the device;

determine, responsive to execution of the plurality of interactions, a plurality of characteristics to indicate a first performance of the user when utilizing the at least one piece of sports equipment of the plurality of pieces of sports equipment;

receive, from the device, a characteristic to indicate a second performance of the at least one piece of sports equipment of the plurality of pieces of sports equipment;

provide, via the device, a second prompt to indicate a first selection of the at least one piece of sports equipment of the plurality of pieces of sports equipment; and receive, from the device, a second indication of a second selection by the user of the at least one piece of sports equipment of the plurality of pieces of sports equipment.

12. The system of claim 11, wherein the characteristic is defined by the user via one or more interactions with the device, and wherein the instructions cause the one or more processors to:

select, responsive to a determination that a difference between the first performance and the second performance is less than a predetermined threshold, the at least one piece of sports equipment of the plurality of pieces of sports equipment; and provide the second prompt to indicate the first selection of the at least one piece of sports equipment of the plurality of pieces of sports equipment.

13. The system of claim 11, wherein the instructions cause the one or more processors to:

receive, from a camera responsive to execution of the plurality of interactions, a first set of data corresponding to one or more aspects of the plurality of interactions;

identify, from the first set of data, information associated with the at least one piece of sports equipment of the plurality of pieces of sports equipment; and determine the plurality of characteristics using at least a portion of the information associated with the at least one piece of sports equipment.

14. The system of claim 11, wherein the instructions cause the one or more processors to:

query, responsive to receipt of the second selection of the at least one piece of sports equipment, a database to identify a plurality of locations where the at least one piece of sports equipment is present;

determine, responsive to identifying the plurality of locations, that a user identified location is absent from the plurality of locations; and identify, using one or more aspects of the at least one piece of sports equipment, one or more second pieces of sports equipment.

15. The system of claim 11, wherein the instructions cause the one or more processors to:

query, responsive to receipt of the second selection of the at least one piece of sports equipment, a database to identify one or more second pieces of sports equipment similar to the at least one piece of sports equipment;

provide, to the device responsive to identification of the one or more second pieces of sports equipment, a visual representation of one or more characteristics of the one or more second pieces of sports equipment;

receive, from the device, a third indication of a selection of the one or more second pieces of sports equipment; and provide, to the device, information associated with one or more sources to obtain the one or more second pieces of sports equipment.

16. The system of claim 11, wherein the instructions cause the one or more processors to:

prompt, responsive to receipt of the first indication of the selection of the plurality of pieces of sports equipment, the user for information to identify a plurality of criteria pertaining to usage of the plurality of pieces of sports equipment;

receive, from the device, the information to identify the plurality of criteria;

determine, using the plurality of criteria and characteristics of the plurality of pieces of sports equipment, that at least one second piece of sports equipment of the plurality of pieces of sports equipment is excluded from consideration; and provide, to the device, a notice to indicate exclusion of the at least one second piece of sports equipment of the plurality of pieces of sports equipment.

17. The system of claim 11, further comprising:

the device including a terminal associated with a sports bay; and the terminal including:

one or more second memory devices storing second instructions thereon that, when executed by one or more second processors, cause the one or more second processors to:

receive, via a display of the terminal, a first selection of a mode of the sports bay;

determine, based on one or more characteristics of the mode, a set of parameters pertaining to a camera proximate to the sports bay; and control, using the set of parameters, the camera to execute a plurality of operations to obtain information associated with the plurality of interactions.

18. A terminal for use with a sports bay, the terminal comprising one or more memory devices storing instructions thereon that, when executed by one or more processors, cause the one or more processors to:

receive, via one or more inputs provided to a display of the terminal, a first indication of a selection of a plurality of pieces of sports equipment, the one or more inputs including information to identify the plurality of pieces of sports equipment;

provide, via the display of the terminal, a first prompt for a user to initiate execution of a plurality of interactions between the user and an object, wherein the user utilizes at least one piece of sports equipment of the plurality of pieces of sports equipment to execute the plurality of interactions responsive to the first prompt being provided via the display;

determine, responsive to execution of the plurality of interactions, a plurality of characteristics to indicate a first performance of the user when utilizing the at least one piece of sports equipment of the plurality of pieces of sports equipment;

receive, via the display of the terminal, a characteristic to indicate a second performance of the at least one piece of sports equipment of the plurality of pieces of sports equipment;

provide, via the display of the terminal, a second prompt to indicate a first selection of the at least one piece of sports equipment of the plurality of pieces of sports equipment; and receive, via the display of the terminal, a second indication of a second selection by the user of the at least one piece of sports equipment of the plurality of pieces of sports equipment.

19. The terminal of claim 18, wherein the characteristic is defined by the user via one or more interactions with the terminal, and wherein the instructions cause the one or more processors to:

select, responsive to a determination that a difference between the first performance and the second performance is less than a predetermined threshold, the at least one piece of sports equipment of the plurality of pieces of sports equipment; and provide the second prompt to indicate the first selection of the at least one piece of sports equipment of the plurality of pieces of sports equipment.

20. The terminal of claim 18, wherein the sports bay includes a camera configured to obtain information associated with interactions within the sports bay, and wherein the instructions cause the one or more processors to:

receive, from the camera responsive to execution of the plurality of interactions, a first set of data corresponding to one or more aspects of the plurality of interactions;

identify, from the first set of data, information associated with the at least one piece of sports equipment of the plurality of pieces of sports equipment; and determine the plurality of characteristics using at least a portion of the information associated with the at least one piece of sports equipment.

* * * * *